US009229345B2

(12) United States Patent
Ikeda et al.

(10) Patent No.: US 9,229,345 B2
(45) Date of Patent: Jan. 5, 2016

(54) TONER

(71) Applicant: CANON KABUSHIKI KAISHA, Tokyo (JP)

(72) Inventors: Naotaka Ikeda, Suntou-gun (JP); Yasuhiro Hashimoto, Mishima (JP); Yuhei Terui, Numazu (JP); Shohei Shibahara, Suntou-gun (JP); Masanori Seki, Yokohama (JP); Waka Hasegawa, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/465,722

(22) Filed: Aug. 21, 2014

(65) Prior Publication Data

US 2015/0056549 A1 Feb. 26, 2015

(30) Foreign Application Priority Data

Aug. 26, 2013 (JP) ..... 2013-175086
Aug. 15, 2014 (JP) ..... 2014-165541

(51) Int. Cl.

| | |
|---|---|
| ***G03G 9/097*** | (2006.01) |
| ***G03G 9/087*** | (2006.01) |
| ***G03G 9/08*** | (2006.01) |
| ***G03G 9/09*** | (2006.01) |

(52) U.S. Cl.

CPC ..... *G03G 9/08755* (2013.01); *G03G 9/0806* (2013.01); *G03G 9/08711* (2013.01); *G03G 9/08791* (2013.01); *G03G 9/08795* (2013.01); *G03G 9/08797* (2013.01); *G03G 9/0904* (2013.01)

(58) Field of Classification Search

CPC ..... G03G 9/08755; G03G 9/0806; G03G 9/0904; G03G 9/08795; G03G 9/08711; G03G 9/08; G03G 9/08702; G03G 9/08791; G03G 9/08797

See application file for complete search history.

(56) References Cited

U.S. PATENT DOCUMENTS

| | | | | |
|---|---|---|---|---|
| 6,890,695 | B2 | 5/2005 | Shirai et al. | |
| 6,936,394 | B2 | 8/2005 | Okado et al. | |
| 8,440,382 | B2 | 5/2013 | Isono et al. | |
| 2005/0090582 | A1 * | 4/2005 | Ushirogouchi et al. | 523/160 |
| 2007/0232722 | A1 * | 10/2007 | Hayata | 523/160 |
| 2012/0094226 | A1 | 4/2012 | Tani et al. | |
| 2013/0224647 | A1 | 8/2013 | Ikeda et al. | |

FOREIGN PATENT DOCUMENTS

| | | | |
|---|---|---|---|
| EP | 2 348 362 | A2 | 7/2011 |
| EP | 2 581 790 | A1 | 4/2013 |
| JP | 2002-287426 | A | 10/2002 |
| JP | 2007-93809 | A | 4/2007 |

OTHER PUBLICATIONS

European Search Report dated Jan. 20, 2014 in European Application No. 14182099.3.

Barton, "Solubility Parameters", Chemical Reviews, vol. 75, No. 6, 1975, pp. 731-753.

* cited by examiner

*Primary Examiner* — Peter Vajda

(74) *Attorney, Agent, or Firm* — Fitzpatrick, Cella, Harper and Scinto

(57) ABSTRACT

The present invention is a toner including toner particles prepared by forming particles of a polymerizable monomer composition including a polymerizable monomer, a pigment, a pigment dispersant and a crystalline polyester resin in an aqueous medium, and polymerizing the polymerizable monomer, wherein the polymerizable monomer is a polymerizable monomer for preparing a vinyl copolymer, the difference in an SP value between the pigment dispersant and the crystalline polyester resin is −1.5 to +0.8, the difference in an SP value between the pigment dispersant an the vinyl copolymer is −1.1 to +1.2, the pigment dispersant has a polymer component and an adsorbable component adsorbed to the pigment, the polymer component is a vinyl polymer, the polymer component of the pigment dispersant has a number average molecular weight of 3,000 to 20,000, and a rate of adsorption of the pigment dispersant to the pigment is 30% or more.

11 Claims, No Drawings

TONER

BACKGROUND OF THE INVENTION

1. Field of the Invention

The present invention relates to a toner for developing an electrostatic charge image, used in electrophotographic image forming apparatus, such as copiers and printers.

2. Description of the Related Art

Recently, energy-saving electrophotographic image forming apparatus, such as copiers and printers, have been demanded because of environmental concerns. An important factor to energy saving is a reduction in fixing energy in particular. To reduce fixing energy, a reduction in the amount of the toner to be applied onto a recording medium (such as paper) has been studied as one of solutions. To reduce the amount of the toner to be applied onto the recording medium, an improvement in the coloring ability of the toner is important.

Examples of the method for improving the coloring ability of the toner include a method of increasing the content of a colorant in toner particles, and a method of improving the dispersibility of a colorant in toner particles. The colorant, which is typically expensive, may increase cost of the toner in the former method. A high content of the colorant in toner particles may increase the influences of the colorant on the chargeability and polarity of the toner, reducing the chargeability of the toner or reducing granulation properties when the toner particles are prepared by a wet method.

In the toner particles prepared by suspension polymerization, a pigment dispersant can temporarily improve the dispersibility of a pigment while this method is susceptible to improvement in stable dispersion of the pigment in a liquid such as a polymerizable monomer.

In preparation of the toner particles by suspension polymerization, a shell layer containing a polar resin is often disposed on the surfaces of the toner particles to enhance stress resistance and chargeability. In such a case, the pigment dispersant may affect the polar resin rather than the pigment in a dispersing step, a granulating step or a reacting step (polymerization step), not attaining a sufficient pigment dispersing effect. The effect of the pigment dispersant on the polar resin may result in an insufficient shell layer disposed, leading to difficulties in precise control of the chargeability of the toner. The effect may also reduce the stress resistance of the toner, preventing high image quality from being kept in long-term use.

Another solution to the reduction in fixing energy is a toner that can be quickly melt at low temperatures to be fixed quickly with small energy. Such a toner has been demanded.

To meet these requirements, the toner has to be softened. Unfortunately, the toner is difficult to simply soften from the viewpoint of heat-resistant storage stability and durability.

Japanese Patent Application Laid-Open Nos. 2002-287426 and 2007-093809 disclose toners the low-temperature fixability of which is improved by incorporating a crystalline resin having sharp-melting properties into toner particles. Through the specification, the term "having sharp-melting properties" means "having a high speed of response to heat." A known crystalline resin includes crystalline polyester resins.

The present inventors, who have conducted extensive research, found that the dispersibility of the pigment is prone to reduce when a crystalline polyester resin is incorporated into the toner particles. In particular, it was found that the dispersibility of the pigment is prone to reduce when the toner particles are prepared by suspension polymerization.

SUMMARY OF THE INVENTION

An object of the present invention is to provide a toner including a pigment still highly dispersible even if the toner includes toner particles prepared by suspension polymerization and containing a crystalline polyester resin.

The present invention provides a toner including toner particles prepared by forming particles of a polymerizable monomer composition including a polymerizable monomer, a pigment, a pigment dispersant and a crystalline polyester resin in an aqueous medium, and polymerizing the polymerizable monomer contained in the particles, wherein the polymerizable monomer is a polymerizable monomer for preparing a vinyl copolymer, and the pigment dispersant satisfies (i) to (v): (i) a difference (A−B) between an SP value (A) of the pigment dispersant and an SP value (B) of the crystalline polyester resin is −1.5 or more and +0.8 or less, (ii) a difference (A−C) between the SP value (A) of the pigment dispersant and an SP value (C) of the vinyl copolymer is −1.1 or more and +1.2 or less, (iii) the pigment dispersant contains a polymer component and an adsorbable component adsorbed to the pigment, and the polymer component is a vinyl polymer, (iv) the polymer component of the pigment dispersant has a number average molecular weight (Mn) of 3,000 or more and 20,000 or less, and (v) a rate of adsorption of the pigment dispersant to the pigment is 30% or more.

The present invention can attain a toner including a pigment still highly dispersible even if the toner includes toner particles prepared by suspension polymerization and containing a crystalline polyester resin.

Further features of the present invention will become apparent from the following description of exemplary embodiments.

DESCRIPTION OF THE EMBODIMENTS

Preferred embodiments of the present invention will now be described in detail.

The toner according to the present invention includes toner particles prepared by forming particles of a polymerizable monomer composition including a polymerizable monomer, a pigment, a pigment dispersant and a crystalline polyester resin in an aqueous medium, and polymerizing the polymerizable monomer contained in the particles. Namely, the toner according to the present invention is a suspension polymerized toner containing a crystalline polyester resin. The binder resin for the toner particles contained in the toner according to the present invention is a vinyl copolymer suitable for suspension polymerization.

The present inventors have conducted research on the pigment dispersant in the suspension polymerized toner containing a crystalline polyester resin, and found that a pigment dispersant having the following structure and physical properties attains the target toner as described above.

The pigment dispersant in the present invention contains a polymer component and an adsorbable component adsorbed to the pigment. The adsorbable component is an "adsorbable component having high adsorbability to the pigment excluding the polymer component in the pigment dispersant," and is hereinafter simply referred to as an "adsorbable component." The polymer component is a "polymer component having high affinity for the binder resin and the polymerizable monomer and an enhanced steric repulsion effect to suppress aggregation of pigments," and is hereinafter simply referred to as a "polymer component."

In the toner according to the present invention, the binder resin refers to a vinyl copolymer that forms a core portion, excluding a resin that forms a shell portion.

The binder resin for the toner particles in the toner according to the present invention is a vinyl copolymer as described above, and the polymer component for the pigment dispersant in the present invention is a vinyl polymer.

In the toner including a vinyl copolymer as the binder resin and a vinyl polymer as the polymer component for the pigment dispersant, such a combination of the binder resin and the polymer component increases the affinity between the binder resin and the pigment dispersant and improves the dispersibility of the pigment in the binder resin.

Furthermore, the difference (A−C) between the SP value (A) of the pigment dispersant and the SP value (C) of the vinyl copolymer as the binder resin is controlled to be −1.1 or more and +1.2 or less. The difference (A−C) in the SP value is controlled to fall within the above range to further increase the affinity between the pigment dispersant and the vinyl copolymer as the binder resin and improve the dispersibility of the pigment.

The toner particles in the toner according to the present invention contain a crystalline polyester resin described later to improve the low-temperature fixability of the toner. The difference (A−B) between the SP value (A) of the pigment dispersant and the SP value (B) of the crystalline polyester resin is −1.5 or more and +0.8 or less, preferably −1.3 or more and +0.5 or less. The difference (A−B) is more preferably −1.0 or more and +0.3 or less. The difference (A−B) in the SP value within the above range can suppress a reduction in the dispersibility of the pigment even if a large amount of the crystalline polyester resin is added to the toner particles to improve the low-temperature fixability of the toner.

The difference (A−B) in the SP value within the above range improves the dispersibility of the pigment probably because of the following action.

In preparation of the toner particles by suspension polymerization, when a polymerizable monomer, a pigment and a crystalline polyester resin are mixed without adding the pigment dispersant, the pigment aggregates due to pigment shock to reduce the dispersibility of the pigment. As a result, the coloring ability of the toner is reduced.

In some cases, to prepare a toner having excellent low-temperature fixability and storage stability, the toner particles containing a crystalline polyester resin are annealed as described later to enhance the crystallinity of the crystalline polyester resin. At this time, the pigment is readily excluded from the crystallized portion of the crystalline polyester resin with crystal growth of the crystalline polyester resin. If a large amount of the crystalline polyester resin is added under such a condition to improve the low-temperature fixability, the space for dispersing the pigment will be reduced and the pigment will aggregates, reducing the coloring ability of the toner.

Moreover, if the pigment dispersant is used to improve the dispersibility of the pigment, the difference (A−B) in the SP value out of the above range will reduce the affinity between the crystalline polyester resin and the pigment dispersant. This reduced affinity will decrease a three-dimensional expansion of the polymer component, which functions to enhance the steric repulsion effect to suppress aggregation of the pigments, in the binder resin or in the polymerizable monomer, thus readily forming the pigment into a coiled shape. The steric repulsion effect is difficult to obtain, and thus to attain sufficient dispersibility of the pigment.

In particular, the pigment and the pigment dispersant are added to the polymerizable monomer, and the pigment is further dispersed in the polymerizable monomer. At this time, if the crystalline polyester resin is further added to the polymerizable monomer, the pigment dispersant is readily removed from the pigment to be deposited. As a result, sufficient dispersibility of the pigment is difficult to attain.

The crystalline polyester resin may be deposited not to attain sufficient low-temperature fixability. If the crystalline polyester resin is deposited to appear on the surfaces of the toner particles or is localized in the toner particles, sufficient low-temperature fixability (plasticity), storage stability and durability are difficult to attain. The crystalline polyester resin often has low resistance. This property causes image fogging (hereinafter, simply referred to as "fogging") or reduced stability of image density as the chargeability of the toner is reduced under high temperature and high humidity environments.

The pigment dispersant has an acid value of preferably 10 mgKOH/g or less, more preferably 5 mgKOH/g or less. At an acid value within the above range, adverse effects on production stability of the toner are barely found, and the pigment is readily dispersed in the binder resin or the polymerizable monomer. The pigment dispersant having an acid value of 10 mgKOH/g or less interacts with a dispersion stabilizer used in an aqueous medium in preparation of the toner particles by suspension polymerization. Such a pigment dispersant does not inhibit the granulation properties of the toner particles.

The pigment dispersant has an amine value of preferably 5 mgKOH/g or less, more preferably 0 mgKOH/g or more and 3 mgKOH/g or less. At an amine value of 5 mgKOH/g or less, the pigment dispersant does not give excessively large positive charge, and does not reduce the chargeability in a negative charging toner.

The structure and the physical properties of the polymer component need to be designed to have the difference in the SP value between the pigment dispersant and the binder resin and the difference in the SP value between the pigment dispersant and the crystalline polyester resin within the above ranges. Preferably, the structure and the physical properties are designed such that the acid value and the amine value of the pigment dispersant fall within the above ranges.

The polymer component needs to have a skeleton having affinity for the binder resin from the viewpoint of the affinity between the pigment dispersant and the binder resin. The suspension polymerized toner can have a skeleton having affinity for a polymerizable monomer for preparing the binder resin.

The binder resin for the toner according to the present invention is a vinyl copolymer. A vinyl polymer is used as the polymer component of the pigment dispersant.

The polymer component of the pigment dispersant can have a unit (monomer unit) represented by Formula (6) when the vinyl copolymer as the binder resin for the toner is a styrene-(meth)acrylic copolymer:

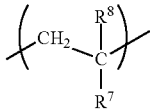

(6)

where $R^8$ represents a hydrogen atom or an alkyl group; $R^7$ represents a phenyl group, a carboxy group, a carboxylic acid ester group or a carboxylic acid amide group.

The unit represented by Formula (6) is more preferably a unit (monomer unit) represented by Formula (1) or (2):

(1)

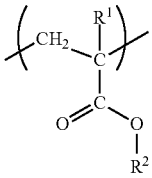

where $R^1$ represents a hydrogen atom or an alkyl group; $R^2$ represents a hydrogen atom, an alkyl group, a phenyl group or an aralkyl group;

(2)

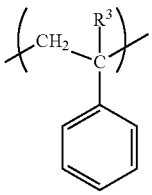

where $R^3$ represents a hydrogen atom or an alkyl group.

Examples of an alkyl group for $R^8$ in Formula (6) include linear alkyl groups, branched alkyl groups and cyclic alkyl groups, such as a methyl group, an ethyl group, an n-propyl group, an n-butyl group, an n-pentyl group, an n-hexyl group, an isopropyl group, an isobutyl group, a sec-butyl group, a tert-butyl group and a cyclohexyl group.

$R^8$ in Formula (6) can be a hydrogen atom or a methyl group from the viewpoint of polymerizability of the polymerizable monomer for forming the unit represented by Formula (6).

The carboxylic acid ester group for $R^7$ in Formula (6) can be a monovalent group represented by —$COOR^2$ (where $R^2$ is the same as $R^2$ in Formula (1)).

Examples of the alkyl group for $R^2$ in Formula (1) include linear alkyl groups, branched alkyl groups and cyclic alkyl groups, such as a methyl group, an ethyl group, an n-propyl group, an n-butyl group, an n-pentyl group, an n-hexyl group, an n-heptyl group, an n-octyl group, an n-nonyl group, an n-decyl group, an n-undecyl group, an n-dodecyl group, an n-tridecyl group, an n-tetradecyl group, an n-pentadecyl group, an n-hexadecyl group, an n-heptadecyl group, an n-octadecyl group, an n-nonadecyl group, an isopropyl group, an isobutyl group, a sec-butyl group, a tert-butyl group, a 2-ethylhexyl group, a cyclopropyl group, a cyclobutyl group, a cyclopentyl group and a cyclohexyl group.

Examples of the aralkyl group for $R^2$ in Formula (1) include a benzyl group, an α-methylbenzyl group and a phenethyl group.

Examples of the carboxylic acid amide group for $R^7$ in Formula (6) include an N-methylamide group, an N,N-dimethylamide group, an N,N-diethylamide group, an N-isopropylamide group, an N-tert-butylamide group and an N-phenylamide group.

The phenyl group, the carboxy group, the carboxylic acid ester group and the carboxylic acid amide group for $R^7$ in Formula (6) may optionally have a substituent. The substituent preferably does not inhibit the polymerizability of the polymerizable monomer for forming the unit represented by Formula (6), and does not reduce the solubility of the pigment dispersant in the polymerizable monomer. Examples of such a substituent include alkoxy groups such as a methoxy group and an ethoxy group; amino groups such as an N-methylamino group and an N,N-dimethylamino group; acyl groups such as an acetyl group; and halogen atoms such as a fluorine atom and a chlorine atom.

When the polymerizable monomer for preparing the binder resin contains a high content of a non-polar substance such as styrene, the proportion of the unit represented by Formula (6) (where $R^7$ is a phenyl group) in the polymer component can be increased from the viewpoint of the affinity for the non-polar substance as a dispersion medium.

When the polymerizable monomer for preparing the binder resin contains a high content of a polar substance such as acrylic acid ester (substance having some polarity), the proportion of the unit represented by Formula (6) (where $R^7$ represents a carboxy group, a carboxylic acid ester group or a carboxylic acid amide group) in the polymer component can be increased from the viewpoint of the affinity for the polar substance as the dispersion medium.

When the polymer component has the unit represented by Formula (1) and $R^2$ in Formula (1) is an alkyl group or an aralkyl group, the differences (A–B) and (A–C) in the SP value can be controlled by adjusting the length of the alkyl chain in $R^2$.

To control the difference (A–B) in the SP value within the above range, $R^2$ in Formula (1) can be an alkyl group having 1 or more and 22 or less carbon atoms or an aralkyl group having 7 or more and 8 or less carbon atoms.

When the polymer component of the pigment dispersant has the unit represented by Formula (1) (where $R^2$ is a hydrogen atom), the acid value of the pigment dispersant can be adjusted by adjusting the proportion of the unit in the polymer component.

In the present invention, the number average molecular weight (Mn) of the polymer component of the pigment dispersant is 3,000 or more and 20,000 or less. At Mn within this range, the polymer component can have an enhanced steric repulsion effect to suppress aggregation of the pigments, thereby improving the dispersibility of the pigment. At a number average molecular weight (Mn) of less than 3,000, the steric repulsion effect is small, and sufficient dispersibility of the pigment is not attained. At a number average molecular weight (Mn) of more than 20,000, the solubility of the pigment dispersant in the polymerizable monomer is reduced, and sufficient dispersibility of the pigment cannot be attained.

A method for improving dispersibility by introducing a branched aliphatic chain into the terminal in a polyoxyalkylenecarbonyl dispersant is known. In the polymer component of the pigment dispersant in the present invention, a branched aliphatic chain can be introduced into the terminal by synthesizing a telechelic polymer component by a method such as ATRP (Atom Transfer Radial Polymerization) described later. This introduction of the branched aliphatic chain may improve the dispersibility of the pigment.

In the present invention, the rate of adsorption of the adsorbable component for the pigment dispersant to the pigment is 30% or more, preferably 70% or more. The adsorption rate can be controlled within the range by design of the structure of the adsorbable component.

The pigment dispersant in the present invention can have a variety of structures that attain strong interaction of the adsorbable component with the pigment and the rate of adsorption to (affinity for) the pigment within the range.

The interaction between the adsorbable component and the pigment may be π-π interaction, interaction through a hydrogen bond or acid-base interaction. The adsorbable component may have a structure in which the pigment readily interacts.

When a pigment that readily interacts through a hydrogen bond is used as the pigment, the adsorbable component can have a functional group such as a hydroxy group and an amide group to enhance the interaction of the adsorbable component with a hydrogen bond.

When a pigment that readily acid-base interacts and has an acidic functional group is used, the adsorbable component can have a basic functional group such as an amino group to enhance the acid-base interaction of the adsorbable component. When a pigment that readily acid-base interacts and has a basic functional group is used, the adsorbable component can have an acidic functional group such as a carboxy group and a sulfonate group.

When a pigment that readily π-π interacts is used, the adsorbable component can have an aromatic skeleton to enhance the π-π interaction of the adsorbable component. The π-π interaction means a dispersion force acting between aromatic rings in an organic compound molecule (London dispersion force). Two aromatic rings tend to be stabilized in a configuration in which coins are stacked, causing stacking interaction. This interaction facilitates adsorption of the pigment dispersant to the surface of the pigment.

When the adsorbable component has an aromatic skeleton, the aromatic skeleton has a firm planar structure and a large amount of electrons unlocalized by the π-electron system is present, so that the London dispersion force is strongly exhibited. The London dispersion force becomes stronger as the π-electrons increase.

When the adsorbable component has an aromatic skeleton, the π-electron cloud of the aromatic skeleton included in the pigment binds to the π-electron cloud of the aromatic skeleton included in the pigment dispersant through the π-π interaction.

Examples of the aromatic skeleton having the π-π interaction include a benzene ring, a naphthalene ring, an anthracene ring, a tetracene ring, a pentacene ring, a hexacene ring and a heptacene ring.

Examples of the compound having the aromatic skeleton include:

compounds having a benzene ring, compounds having a naphthalene ring, compounds having an anthracene ring, compounds having a tetracene ring, compounds having a pentacene ring, compounds having a hexacene ring and compounds having a heptacene ring.

More specifically examples thereof include dimethyl 2,6-naphthalenedisulfonate, 2-naphthalenecarboxylic acid, benzoic acid and 4,5-dihydroxy-9,10-dioxo-9,10-dihydroanthracene-2-carboxylic acid.

For the adsorbable component of the pigment dispersant in the present invention, to prepare an adsorbable component that is readily adsorbed to any of the pigment that readily π-π interacts, the pigment that readily interacts through a hydrogen bond, and the pigment that readily acid-base interacts, the adsorbable component can have a basic functional group such as an amino group or an acidic functional group such as a carboxy group and a sulfonate group, and can have an aromatic skeleton.

The average number of the adsorbable component per molecule of the pigment dispersant in the present invention can be 1 or more and 6 or less. If the number of the adsorbable component in the pigment dispersant is 6 or less, miscibility with the polymerizable monomer is readily increased.

The adsorbable component in the pigment dispersant may be present at random with respect to the polymer component, or may form one or more of blocks at one end to be localized.

The adsorbable component of the pigment dispersant in the present invention can have a partial structure represented by Formula (3) (azo skeleton partial structure):

(3)

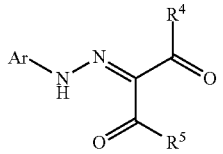

where one of $R^4$, $R^5$ and Ar is a structure to which the polymer component binds through a single bond or a linking group; $R^4$ represents an alkyl group, a phenyl group, a monovalent group represented by —$OR^8$ (where $R^8$ represents a hydrogen atom, an alkyl group, a phenyl group or an aralkyl group), or a monovalent group represented by —$NR^9R^{10}$ (where $R^9$ and $R^{10}$ each independently represent a hydrogen atom, an alkyl group, a phenyl group or an aralkyl group), or a structure to which the polymer component binds through a single bond or a linking group (in this case, the structure corresponding to an alkyl group, a phenyl group, a monovalent group represented by —$OR^8$, or a monovalent group represented by —$NR^9R^{10}$ from which one hydrogen atom is removed); when $R^4$ is a structure that binds to the polymer component, the linking group binding to $R^4$ is an amide group, an ester group, a urethane group, a urea group, an alkylene group, a phenylene group, a divalent group represented by —O—, a divalent group represented by —$NR^6$— ($R^6$ represents a hydrogen atom, an alkyl group, a phenyl group or an aralkyl group), or a divalent group represented by —$NHCH(CH_2OH)$—; $R^5$ represents an alkyl group, a phenyl group, a monovalent group represented by —$OR^8$ (where $R^8$ represents a hydrogen atom, an alkyl group, a phenyl group or an aralkyl group), or a monovalent group represented by —$NR^9R^{10}$ ($R^9$ and $R^{10}$ each independently represent a hydrogen atom, an alkyl group, a phenyl group or an aralkyl group), or a structure to which the polymer component binds through a single bond or a linking group (in this case, the structure corresponding to an alkyl group, a phenyl group, a monovalent group represented by —$OR^8$, or a monovalent group represented by —$NR^9R^{10}$ from which one hydrogen atom is removed); when $R^5$ is a structure that binds to the polymer component, the linking group binding to $R^5$ is an alkylene group, a phenylene group, a divalent group represented by —O—, a divalent group represented by —$NR^6$— (where $R^6$ represents a hydrogen atom, an alkyl group, a phenyl group or an aralkyl group), a divalent group represented by —$NHCOC(CH_3)_2$—, or a divalent group represented by —$NHCH(CH_2OH)$—; Ar represents an aryl group or a structure that binds to the polymer component through a single bond or a linking group (in this case, the structure corresponding to an aryl group from which one hydrogen atom is removed); when Ar is a structure that binds to the polymer component, the linking group binding to Ar is an amide group, an ester group, a urethane group, a urea group, an alkylene group, a phenylene group, a divalent group represented by —O—, a divalent group represented by —$NR^6$— (where $R^6$ represents a hydrogen atom, an alkyl group, a phenyl group or an aralkyl group), and a divalent group represented by —$NHCH(CH_2OH)$—.

When the adsorbable component of the pigment dispersant in the present invention has an azo skeleton partial structure such as a partial structure represented by Formula (3), the pigment dispersant has high adsorbability to azo pigments.

Examples of an alkyl group for $R^4$ and $R^5$ in Formula (3) include linear alkyl groups, branched alkyl groups and cyclic alkyl groups such as a methyl group, an ethyl group, an n-propyl group, an n-butyl group, an n-pentyl group, an n-hexyl group, an isopropyl group, an isobutyl group, a sec-butyl group, a tert-butyl group and a cyclohexyl group.

$R^4$ and $R^5$ in Formula (3) are preferably a monovalent group represented by —$NR^{11}R^{12}$ from the viewpoint of the adsorbability of the azo skeleton partial structure in Formula (3) to the pigment having a π-conjugate plane through π-π interaction. More preferably, $R^{11}$ in —$NR^{11}R^{12}$ is a hydrogen atom and $R^{12}$ is a phenyl group. Examples of the pigment having a π-conjugate plane include carbon black, copper phthalocyanine, quinacridone and carmine.

Examples of an alkyl group for $R^{10}$ to $R^{12}$ in Formula (3) include linear alkyl groups, branched alkyl groups and cyclic alkyl groups such as a methyl group, an ethyl group, an n-propyl group, an n-butyl group, an n-pentyl group, an n-hexyl group, an isopropyl group, an isobutyl group, sec-butyl group, tert-butyl group and a cyclohexyl group.

Examples of an aralkyl group for $R^{10}$ to $R^{12}$ in Formula (3) include a benzyl group and a phenethyl group.

Examples of an aryl group for Ar in Formula (3) include a phenyl group and a naphthyl group.

When the adsorbable component of the pigment dispersant in the present invention has the partial structure represented by Formula (3), Ar in Formula (3) enhances the adsorbability to the pigment having a π-conjugate plane.

Ar in Formula (3) may be an aryl group (unsubstituted aryl group) as described above, or may be an aryl group having a substituent from the viewpoint of an increase in the adsorbability of the adsorbable component of the pigment dispersant to the pigment by a hydrogen bond. Ar in Formula (3) may be an aryl group (unsubstituted aryl group) from which one hydrogen atom is removed, or may be an aryl group having a substituent from which one hydrogen atom is removed from the same viewpoint. The substituent can be selected such that the azo skeleton partial structure does not significantly inhibit the adsorbability to the pigment having a π-conjugate plane through π-π interaction. Examples of the substituent include an alkyl group, an alkoxy group, a halogen atom, a hydroxy group, a cyano group, a trifluoromethyl group, a carboxy group, a carboxylic acid ester group and a carboxylic acid amide group. These substituents can be selected so as to form a hydrogen bond to the functional group of the pigment to enhance the adsorbability.

As described above, one of $R^4$, $R^5$ and Ar in Formula (3) is a structure that binds to the polymer component through a single bond or a linking group. From the viewpoint of the adsorbability of the pigment dispersant to the pigment, the partial structure represented by Formula (3) can be a partial structure represented by Formula (7) (azo skeleton partial structure):

(7)

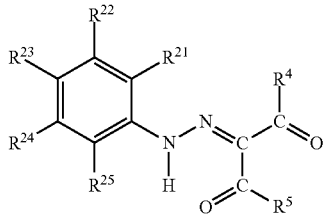

where one of $R^4$, $R^5$ and $R^{21}$ to $R^{25}$ is a structure that binds to the polymer component through a single bond or a linking group; $R^4$ and $R^5$ each are the same as $R^4$ and $R^5$ in Formula (3); $R^{21}$ to $R^{25}$ each independently represent a hydrogen atom, a monovalent group represented by —$COOR^{26}$ ($R^{26}$ represents a hydrogen atom, an alkyl group, a phenyl group or an aralkyl group), or a monovalent group represented by —$CONR^{27}R^{28}$ ($R^{27}$ and $R^{28}$ each independently represent a hydrogen atom, an alkyl group, a phenyl group or an aralkyl group), or a structure that binds to the polymer component through a single bond or a linking group (in this case, the structure corresponding to a hydrogen atom, a monovalent group represented by —$COOR^{26}$, or a monovalent group represented by —$CONR^{27}R^{28}$ from which one hydrogen atom is removed).

Of $R^{21}$ to $R^{25}$ in Formula (7), at least one can be a monovalent group represented by —$COOR^{26}$ or a monovalent group represented by —$CONR^{27}R^{28}$ from the viewpoint of the adsorbability to the pigment having the azo skeleton partial structure by a hydrogen bond.

Examples of an alkyl group for $R^{26}$ to $R^{28}$ in —$COOR^{26}$ or —$CONR^{27}R^{28}$ include a methyl group, an ethyl group, an n-propyl group and an isopropyl group.

From the viewpoint of the adsorbability to the pigment having the azo skeleton partial structure, $R^{26}$ in —$COOR^{26}$ can be a methyl group. From the same viewpoint, $R^{27}$ in —$CONR^{27}R^{28}$ can be a methyl group, and $R^{28}$ can be a hydrogen atom or a methyl group. A hydrogen atom or a methyl group, both of which are not bulky, barely causes steric hindrance so that a hydrogen bond to the pigment is readily formed and the π-π interaction is difficult to inhibit.

As described above, one of $R^4$, $R^5$ and Ar in Formula (3) is a structure that binds to the polymer component through a single bond or a linking group. From the viewpoint of the adsorbability of the pigment dispersant to the pigment and ease of production of the pigment dispersant, $R^5$ in Formula (3) can be a monovalent group represented by —$NR^{11}R^{12}$, $R^{11}$ in —$NR^{11}R^{12}$ can be a hydrogen atom, and $R^{12}$ can be a phenylene group. The phenylene group for $R^{12}$ is a structure to which the polymer component binds.

The partial structure represented by Formula (3) is more preferably a partial structure represented by Formula (8) or a partial structure represented by Formula (9) from the viewpoint of the adsorbability of the pigment dispersant to the pigment:

(8)

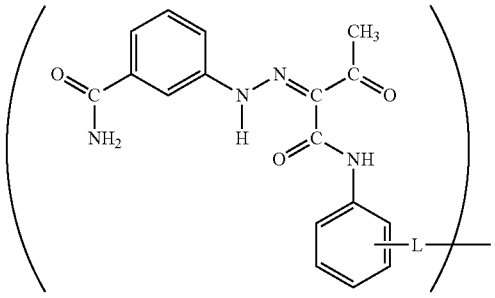

-continued (9)

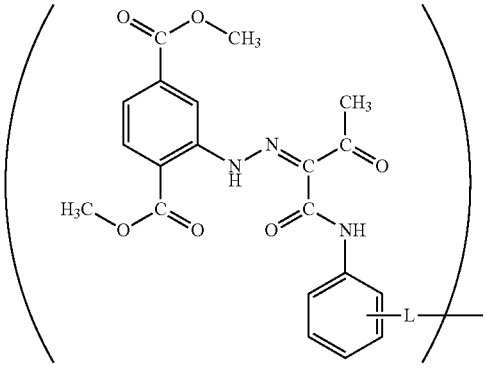

where L represents a divalent linking group, and the partial structure represented by Formula (8) and the partial structure represented by Formula (9) each bind to the polymer component through L.

Examples of the divalent linking group for L in Formulae (8) and (9) include divalent groups having a carboxylic acid ester bond, a carboxylic acid amide bond and a sulfone acid ester bond.

Examples of a bond position (substitution position) of L to a benzene ring in Formulae (8) and (9) include o-position, m-position and p-position with respect to an amide group binding to the benzene ring.

$R^4$ to $R^{28}$ need to be selected such that the difference in zeta potential between the pigment dispersant in the present invention and the vinyl copolymer as the binder resin falls within the range. $R^4$ to $R^{28}$ can be selected such that the pigment dispersant in the present invention has a suitable acid value and amine value.

For the position of the adsorbable component in the pigment dispersant, the adsorbable component may form one or more of blocks and bind to the polymer component at random, or may form one or more of blocks and bind to one end or both ends of the polymer component.

As the number of the adsorbable component in the pigment dispersant is larger, the adsorbability to the pigment will be enhanced. As the number of the adsorbable component in the pigment dispersant is smaller, the affinity for the polymerizable monomer will be higher. The number of the adsorbable component in the pigment dispersant is preferably 0.5 or more and 15.0 or less based on 100 monomers that form the polymer component (the number of the units that form the polymer component). The number of the adsorbable component is more preferably 2.0 or more and 10.0 or less.

As shown below, the partial structure represented by Formula (3) has a tautomer such as a partial structure represented by Formula (10) and a partial structure represented by Formula (11). The adsorbable component of the pigment dispersant in the present invention may be not only the partial structure represented by Formula (3), but also a tautomer thereof. The partial structure represented by Formula (3) has a tautomer, which attains π-π interaction with the pigment stronger than that in the pigment dispersant in the related art. Such strong π-π interaction is attained probably because of, in addition to the allyl group in the partial structure represented by Formula (3), an azo bond directly binding to the allyl group, and a resonance structure having a carbonyl group disposed so as to influence the azo bond and resonate.

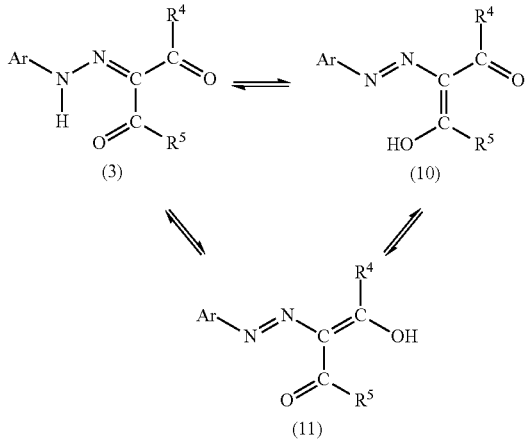

where $R^4$, $R^5$ and Ar each are the same as $R^4$, $R^5$ and Ar in Formula (3).

Examples of a method of synthesizing a pigment dispersant include Methods (i) to (iv).

Now, an example of a scheme of Method (i) will be shown.

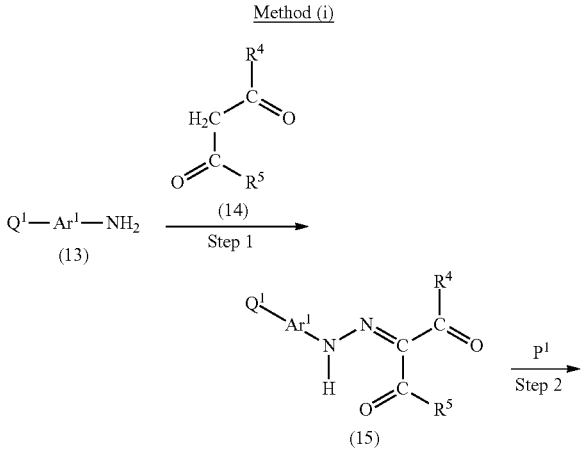

where $R^4$ and $R^5$ each represent an alkyl group, a phenyl group, a monovalent group represented by —$OR^8$ (where $R^8$ represents a hydrogen atom, an alkyl group, a phenyl group or an aralkyl group), or a monovalent group represented by —$NR^9R^{10}$ (where $R^9$ and $R^{10}$ each independently represent a hydrogen atom, an alkyl group, a phenyl group or an aralkyl group); $Ar^1$ represents an arylene group; $Q^1$ represents a group for reacting with $P^1$ to form the linking group (such as L in Formulae (8) and (9)); $P^1$ represents a polymer component having the unit represented by Formula (6), for example.

In the scheme in Method (i), the pigment dispersant can be synthesized by Step 1 and Step 2.

In Step 1, a compound represented by Formula (13) (aniline derivative) is diazo coupled with a compound represented by Formula (14) to synthesize a compound represented by Formula (15). The compound represented by Formula (15) is a compound serving as a base for the azo skeleton partial structure.

In Step 2, the compound represented by Formula (15) is bonded to the polymer component $P^1$ by a condensation reaction or the like.

Step 1 includes the following steps.

First, the compound represented by Formula (13) is reacted with a diazotizing agent such as sodium nitrite and nitrosylsulfuric acid in the presence of an inorganic acid such as hydrochloric acid and sulfuric acid in a methanol solvent to synthesize a corresponding diazonium salt. The synthesized diazonium salt is coupled with the compound represented by Formula (14) to synthesize the compound represented by Formula (15).

The compound represented by Formula (13) (aniline derivative) is commercially available and is easily available. The compound represented by Formula (13) can also be easily synthesized by a known method.

Step 1 can be performed in the absence of a solvent. To suppress rapid progression of the reaction, Step 1 can be performed in the presence of a solvent.

Solvents that do not inhibit the reaction can be used. Examples thereof include alcohols such as methanol, ethanol and propanol; esters such as methylacetate, ethyl acetate and propyl acetate; ethers such as diethyl ether, tetrahydrofuran (THF) and dioxane; hydrocarbons such as benzene, toluene, xylene, hexane and heptane; halogen-containing hydrocarbons such as dichloromethane, dichloroethane and chloroform; amides such as N,N-dimethylformamide, N-methylpyrrolidone and N,N-dimethylimidazolidinone; nitriles such as acetonitrile and propionitrile; acids such as formic acid, acetic acid and propionic acid; and water.

These solvents may be used alone or in combination. When these solvents are used in combination, the mixing ratio can be determined depending on the solubility of a solute (substrate). The amount of the solvent to be used is preferably 1.0 mass times or more and 20 mass times or less based on the compound represented by Formula (13) from the viewpoint of the reaction rate.

Step 1 can be performed at a temperature of −50° C. or more and 100° C. or less. Step 1 can be terminated within 24 hours.

Examples of a method of synthesizing the polymer component $P^1$ used in Step 2 include radical polymerization, cationic polymerization and anionic polymerization. Among these, radical polymerization is preferable from the viewpoint of ease of production.

Radical polymerization can be performed by use of a radical polymerization initiator, irradiation with radiation or laser beams, use of a photopolymerization initiator in combination with irradiation with light, or heating.

The radical polymerization initiator can generate radicals to start the polymerization reaction. Examples of the radical polymerization initiator include compounds that generate radicals by action of heat, light, radiation or oxidation reduction reaction. Specifically, examples thereof include pigment dispersants, organic peroxides, inorganic peroxides, organic metal compounds and photopolymerization initiators.

More specifically, examples thereof include azo polymerization initiators such as 2,2'-azobis(isobutyronitrile), 2,2'-azobis(2-methylbutyronitrile), 2,2'-azobis(4-methoxy-2,4-dimethylvaleronitrile) and 2,2'-azobis(2,4-dimethylvaleronitrile); organic peroxide polymerization initiators such as benzoyl peroxide, di-tert-butyl peroxide, tert-butylperoxy isopropylcarbonate, tert-hexyl peroxybenzoate and tert-butyl peroxybenzoate; inorganic peroxide polymerization initiators such as potassium persulfate and ammonium persulfate; and redox initiators such as hydrogen peroxide-ferrous redox initiators, benzoyl peroxide-dimethylaniline redox initiators and cerium(IV) salt-alcohol redox initiators.

Examples of the photopolymerization initiators include benzophenones, benzoin ethers, acetophenones and thioxanthones.

These radical polymerization initiators may be used alone or in combination.

The amount of the polymerization initiator to be used can be adjusted so as to prepare a polymer component having a target molecular weight distribution. Specifically, the amount can be 0.1 parts by mass or more and 20 parts by mass or less based on 100 parts by mass of the monomer to be polymerized.

The polymer component $P^1$ can also be prepared by a polymerization method such as solution polymerization, suspension polymerization, emulsion polymerization, dispersion polymerization, precipitation polymerization and bulk polymerization. Among these, solution polymerization is preferable because the components to be used for preparation can be dissolved in a solvent.

The molecular weight distribution and the molecular structure of the polymer component $P^1$ can be controlled. Examples of the method for controlling the molecular weight distribution and the molecular structure include: a method using an addition-fragmentation chain transfer agent; NMP (nitroxide mediated polymerization) method using dissociation and binding of amine oxide radicals; ATRP (atom transfer radical polymerization) method by polymerization with a halogen compound as a polymerization initiator, a heavy metal and a ligand; RAFT (reversible addition fragmentation chain transfer) method using a dithiocarboxylic acid ester or a xanthate compound as a polymerization initiator; MADIX (Macromolecular Design via Interchange of Xanthate) method; DT (Degenerative transfer) method.

In Step 2, for example, the polymer component $P^1$ having a carboxy group, and a compound represented by Formula (15) where a substituent $Q^1$ has a hydroxy group can be used to synthesize a pigment dispersant whose linking group has a carboxylic acid ester bond. Alternatively, the polymer component $P^1$ having a hydroxy group, and a compound represented by Formula (15) where a substituent $Q^1$ has a sulfonic acid group can be used to synthesize a pigment dispersant whose linking group has a sulfone acid ester bond. Alternatively, the polymer component $P^1$ having a carboxy group, and a compound represented by Formula (15) where a substituent $Q^1$ has an amino group can be used to synthesize a pigment dispersant whose linking group has carboxylic acid amide bond.

Step 2 can use a method using a dehydration condensing agent such as 1-ethyl-3-(3-dimethylaminopropyl)carbodiimide hydrochloride or a Schotten-Baumann method, for example.

Step 2 can be performed in the absence of a solvent. To suppress rapid progression of the reaction, Step 2 is preferably performed in the presence of a solvent.

Any solvent that does not inhibit the reaction can be used, and examples thereof include ethers such as diethyl ether, tetrahydrofuran and dioxane; hydrocarbons such as benzene, toluene, xylene, hexane and heptane; halogen-containing hydrocarbons such as dichloromethane, dichloroethane and chloroform; amides such as N,N-dimethylformamide, N-methylpyrrolidone and N,N-dimethylimidazolidinone; and nitriles such as acetonitrile and propionitrile.

These solvents may be used alone or in combination. When these solvents are used in combination, the mixing ratio can be determined depending on the solubility of a solute (substrate). The amount of the solvent to be used is preferably 1.0 mass times or more and 20 mass times or less based on the compound represented by Formula (15) from the viewpoint of the reaction rate.

Step 2 can be performed at a temperature of 00° C. or more and 250° C. or less. Step 2 can be terminated within 24 hours.

Now, an example of a scheme of Method (ii) will be shown:

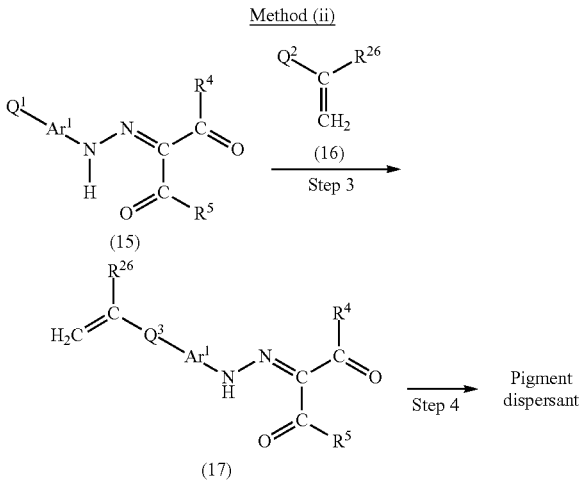

where $R^4$, $R^5$, $Ar^1$ and $Q^1$ in Formula (15) each are the same as $R^4$, $R^5$, $Ar^1$ and $Q^1$ in Formula (15) in the scheme of Method (i); $Q^2$ represents a group that reacts with $Q^1$ in Formula (15) to form $Q^3$ in Formula (17); $R^{26}$ represents a hydrogen atom or an alkyl group; $Q^3$ is a group formed by a reaction of $Q^1$ in Formula (15) and $Q^2$ in Formula (16) and corresponding to the linking group (such as L in Formulae (8) and (9)).

In the scheme of Method (ii), the pigment dispersant can be synthesized by Step 3 and Step 4.

In Step 3, the compound represented by Formula (15) is reacted with the compound represented by Formula (16) (vinyl group-containing compound) to synthesize a compound represented by Formula (17) having a polymerizable functional group. The compound represented by Formula (15) is a compound serving as a base of the azo skeleton partial structure.

In Step 4, the compound represented by Formula (17) is copolymerized with a monomer serving as the base of the unit represented by Formula (2).

In Step 3, the compound represented by Formula (17) having a polymerizable functional group can be synthesized by the same method as that in Step 2 in Method (i). For example, a compound represented by Formula (16) and having a carboxy group and a compound represented by Formula (15) where a substituent $Q^1$ has a hydroxy group can be used to synthesize the compound represented by Formula (17). The compound represented by Formula (17) has a polymerizable functional group and the linking group $Q^3$ has a carboxylic acid ester bond. Alternatively, a compound represented by Formula (16) and having a hydroxy group and a compound represented by Formula (15) where a substituent $Q^1$ has a sulfonic acid group can be used to synthesize the compound represented by Formula (17). The compound represented by Formula (17) has a polymerizable functional group and the linking group $Q^3$ has a sulfone acid ester bond. Alternatively, a compound represented by Formula (16) and having a carboxy group and a compound represented by Formula (15) where a substituent $Q^1$ has an amino group can be used to synthesize the compound represented by Formula (17). In the compound represented by Formula (17), the linking group $Q^3$ has a carboxylic acid amide bond.

The compound represented by Formula (16) is commercially available and easily available. The compound represented by Formula (16) can also be easily synthesized by a known method.

In Step 4, a pigment dispersant having the unit represented by Formula (1) can be synthesized by the same method of synthesizing the polymer component $P^1$ in Method (i).

Now, an example of a scheme of Method (iii) will be shown:

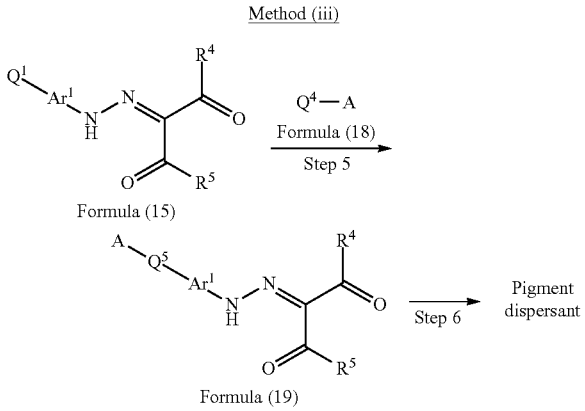

where $R^4$, $R^5$, $Ar^1$ and $Q^1$ each are the same as $R^4$, $R^5$, $Ar^1$ and Q in Formula (15) in the scheme of Method (i); $Q^4$ represents a group that reacts with $Q^1$ in Formula (15) to form $Q^5$ in Formula (19); A represents a chlorine atom, a bromine atom or an iodine atom; $R^4$, $R^5$ and $Ar^1$ in Formula (19) each are the same as $R^4$, $R^5$ and Ar in Formula (15). $Q^5$ is a group formed by reacting $Q^1$ in Formula (15) and $Q^4$ in Formula (18) and corresponding to the linking group (such as L in Formulae (8) and (9)).

In the scheme of Method (iii), the pigment dispersant can be synthesized by Step 5 and Step 6.

In Step 5, the compound represented by Formula (15) is reacted with the compound represented by Formula (18) (halogen atom-containing compound) to synthesize a compound represented by Formula (19) having a halogen atom (chlorine atom, bromine atom or iodine atom).

In Step 6, a monomer serving as the base of the unit represented by Formula (2) is copolymerized with the compound represented by Formula (19) as the polymerization initiator.

In Step 5, the compound represented by Formula (19) having a halogen atom can be synthesized by the same method as that in Step 2 in Method (i). For example, a compound represented by Formula (18) and having a carboxy group and a compound represented by Formula (15) where a substituent $Q^1$ has a hydroxy group can be used to synthesize a compound represented by Formula (19) and having a halogen atom. Alternatively, a compound represented by Formula (18) and having a hydroxy group and a compound represented by Formula (15) where a substituent Q has a sulfonic acid group can be used to synthesize a compound represented by Formula (19) having a halogen atom. Alternatively, a compound represented by Formula (18) and having a carboxy group and a compound represented by Formula (15) where a substituent $Q^1$ has an amino group can be used to synthesize a compound represented by Formula (19) having a halogen atom.

Examples of the compound represented by Formula (18) having a carboxy group include chloroacetic acid, α-chloropropionic acid, α-chlorobutyric acid, α-chloroisobutyric acid, α-chlorovaleric acid, α-chloroisovaleric acid, α-chlorocaproic acid, α-chlorophenylacetic acid, α-chlorodiphenylacetic acid, α-chloro-α-phenylpropionic acid, α-chloro-β-phenylpropionic acid, bromoacetic acid, α-bromopropionic acid, α-bromobutyric acid, α-bromoisobutyric acid, α-bromovaleric acid, α-bromoisovaleric acid, α-bromocaproic acid, α-bromophenylacetic acid, α-bromodiphenylacetic acid, α-bromo-α-phenylpropionic acid, α-bromo-β-phenylpropionic acid, iodoacetic acid, α-iodopropionic acid, α-iodobutyric acid, α-iodoisobutyric acid, α-iodovaleric acid, α-iodoisovaleric acid, α-iodocaproic acid, α-iodophenylacetic acid, α-iododiphenylacetic acid, α-iodo-α-phenylpropionic acid, α-iodo-β-phenylpropionic acid, β-chlorobutyric acid, β-bromoisobutyric acid, iododimethylmethylbenzoic acid and 1-chloroethylbenzoic acid. Examples thereof also include halides thereof and acid anhydrides thereof.

Examples of the compound represented by Formula (18) and having a hydroxy group include 1-chloroethanol, 1-bromoethanol, 1-iodoethanol, 1-chloropropanol, 2-bromopropanol, 2-chloro-2-propanol, 2-bromo-2-methylpropanol, 2-phenyl-1-bromoethanol and 2-phenyl-2-iodoethanol.

In Step 6, the ATRP method in the Method (i) is used. The monomer serving as the base of the unit represented by Formula (2) can be polymerized with the compound represented by Formula (19) and having a halogen atom as the polymerization initiator in the presence of a metal catalyst and a ligand to synthesize the pigment dispersant.

The pigment dispersant containing the component represented by Formula (3) (where $R^5$ is a monovalent group represented by —$NR^{11}R^{12}$, $R^{11}$ is a hydrogen atom, and $R^{12}$ is a phenyl group) can be synthesized by Method (iv) below, for example:

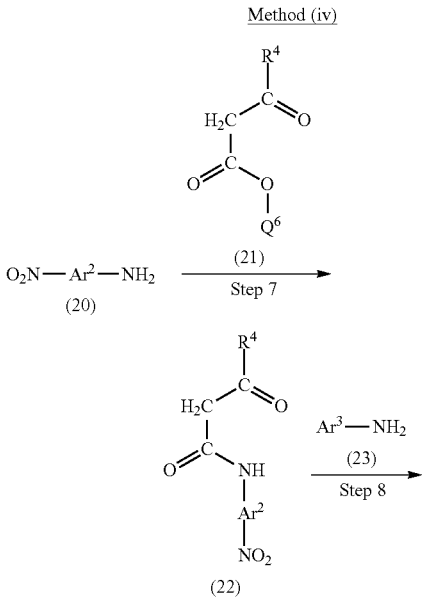

-continued

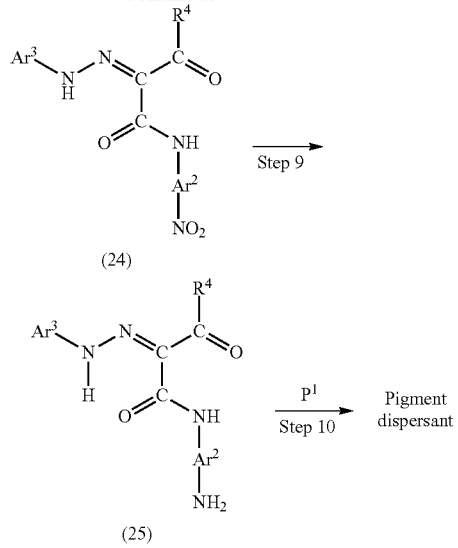

where $Ar^2$ represents an arylene group; $R^4$ is the same as $R^4$ in Formula (3); $Q^6$ represents a group that reacts with an amino group in Formula (20) to dissociate in formation of an amide group in Formula (22); $P^1$ is the same as $P^1$ in the scheme of Method (i).

In the scheme of Method (iv), the pigment dispersant can be synthesized by Steps 7, 8, 9 and 10.

In Step 7, a compound represented by Formula (20) (aniline derivative) and a compound represented by Formula (21) are amidized to prepare a compound represented by Formula (22).

In Step 8, a compound represented by Formula (22) is coupled with a diazo component of a compound represented by Formula (23) (aniline analog) to prepare a compound represented by Formula (24). The compound represented by Formula (24) is a compound serving as the base of the azo skeleton partial structure.

In Step 9, a nitro group of the compound represented by Formula (24) is reduced to an amino group with a reducing agent to prepare a compound represented by Formula (25). The compound represented by Formula (25) is a compound serving as the base of the azo skeleton partial structure.

In Step 10, an amino group of the compound represented by Formula (25) is amidized to bind to a carboxy group of the polymer component $P^1$ separately synthesized.

In Step 7, a known method can be used. For the compound represented by Formula (22) where $R^4$ is a methyl group, the target compound can also be synthesized by a method using diketene instead of the compound represented by Formula (21). The compound represented by Formula (21) is commercially available and easily available. The compound represented by Formula (21) can also be easily synthesized by a known method.

Step 7 can be performed in the absence of a solvent. To suppress rapid progression of the reaction, Step 7 is preferably performed in the presence of a solvent.

Any solvent that does not inhibit the reaction can be used. Examples thereof include solvents (high boiling point solvents) such as toluene and xylene.

In Step 8, the compound represented by Formula (24) can be synthesized by the same method as that in Step 1 of Method (i).

In Step 9, a nitro group can be reduced by the following method, for example.

First, the compound represented by Formula (24) is dissolved in a solvent such as alcohol, and the nitro group of the compound represented by Formula (24) is reduced to an amino group in the presence of a reducing agent under normal temperature or under a heating condition to prepare a compound represented by Formula (25). Examples of the reducing agent include sodium sulfide, sodium hydrogen sulfide, sodium hydrosulfide, sodium polysulfide, iron, zinc, tin, $SnCl_2$ and $SnCl_2.2H_2O$. The reduction reaction can also be progressed by a method of contacting hydrogen gas in the presence of a catalyst composed of a metal such as nickel, platinum and palladium and an insoluble carrier supporting the metal, such as activated carbon.

In Step 10, an amino group of the compound represented by Formula (25) can be amidized to bind to a carboxy group of the polymer component $P^1$ by the same method as that in Step 2 of Method (i) to synthesize the pigment dispersant.

The compound prepared through the respective steps of the synthetic method can be refined by a method for isolating an organic compound or a refining method therefor such as recrystallization and reprecipitation with an organic solvent or by column chromatography with silica gel or the like. The prepared compound can be refined by one of these methods or in combination thereof to prepare a compound with high purity.

Next, a toner according to the present invention and the method of producing the toner will be described in detail.

The toner according to the present invention has a weight average particle diameter (D4) of preferably 4.0 m or more and 9.0 μm or less, more preferably 5.0 μm or more and 7.5 μm or less.

The toner having a weight average particle diameter of 4.0 μm or more barely causes charge up to reduce fogging, scattering and low image density caused by charge up. Such a toner barely contaminates a charging member or the like even in long-term image output, readily providing high quality images stably. The transfer remaining toner on the surface of an electrophotographic photosensitive member is readily cleaned to prevent the toner from being fused to the surface of the electrophotographic photosensitive member.

The toner having a weight average particle diameter of 9.0 μm or less barely causes a reduction in reproductivity of thin lines such as small characters, and image scattering, readily providing high quality images.

The toner according to the present invention is produced by suspension polymerization.

In the method of producing the toner according to the present invention, the pigment dispersant is premixed with a pigment to prepare a pigment composition (masterbatch). Thereby, the dispersibility of the pigment can be improved. Specifically, the pigment dispersant, a pigment and optional raw materials for the toner are added to a dispersion medium, and are mixed sufficiently with the dispersion medium while being stirred. The pigment can be stably dispersed into uniform fine particles with a disperser such as a kneader, a roll mill, a ball mill, a paint shaker, a dissolver, an Attritor, a sand mill, a high speed mill, an SC mill, a star mill and an ultrasonic disperser.

The dispersion medium can be a polymerizable monomer for preparing a vinyl copolymer from the viewpoint of a pigment dispersing effect.

The toner particles contained in the toner according to the present invention can be prepared by, for example, the following method (the so-called suspension polymerization).

The pigment composition, the polymerizable monomer, a release agent, a polymerization initiator and the like are mixed to prepare a polymerizable monomer composition. Next, the polymerizable monomer composition is dispersed in an aqueous medium to form particles of the polymerizable monomer composition (granulation). The polymerizable monomer contained in the particles of the polymerizable monomer composition is polymerized in the aqueous medium to prepare toner particles.

The toner particles contained in the toner according to the present invention contains a binder resin composed of a vinyl copolymer. For this reason, two or more vinyl polymerizable monomers allowing radical polymerization are used as the polymerizable monomer. For the vinyl polymerizable monomer, monofunctional polymerizable monomers and polyfunctional polymerizable monomers can be used.

Examples of the monofunctional polymerizable monomers include: styrene, and styrene/styrene derivatives such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene and p-phenylstyrene (styrene monomers); acrylic polymerizable monomers such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethylphosphate ethylacrylate, diethylphosphate ethyl acrylate, dibutylphosphate ethyl acrylate and 2-benzoyloxyethyl acrylate; methacrylic polymerizable monomers such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethylphosphate ethyl methacrylate and dibutylphosphate ethyl methacrylate; methylene aliphatic monocarboxylic acid esters; vinyl esters such as vinyl acetate, vinyl propionate, vinyl butyrate, vinyl benzoate and vinyl formate; vinyl ethers such as vinyl methyl ether, vinyl ethyl ether and vinyl isobutyl ether; and vinyl ketones such as vinyl methyl ketone, vinyl hexyl ketone and vinyl isopropyl ketone.

Examples of the polyfunctional polymerizable monomers include: diethylene glycol diacrylate, triethylene glycol diacrylate, tetraethylene glycol diacrylate, polyethylene glycol diacrylate, 1,6-hexanediol diacrylate, neopentylglycol diacrylate, tripropylene glycol diacrylate, polypropylene glycol diacrylate, 2,2'-bis(4-(acryloxydiethoxy)phenyl)propane, trimethylolpropane triacrylate, tetramethylolmethane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, 2,2'-bis(4-(methacryloxydiethoxy)phenyl)propane, 2,2'-bis(4-(methacryloxypolyethoxy)phenyl)propane, trimethylolpropane trimethacrylate, tetramethylolmethane tetramethacrylate, divinylbenzene, divinylnaphthalene and divinyl ether.

The polyfunctional polymerizable monomer can also be used as a crosslinking agent.

The polymerizable monomer composition can be prepared by dispersing a pigment composition in a first polymerizable monomer to prepare a dispersion liquid, and mixing the dispersion liquid with a second polymerizable monomer. Namely, after the pigment composition is sufficiently dispersed with the first polymerizable monomer, the mixture is mixed with the second polymerizable monomer and other toner materials. Thereby, the pigment can be present in a satisfactory dispersion state in the toner particles.

An oil-soluble initiator and/or a water-soluble initiator is used as the polymerization initiator for the polymerization of the polymerizable monomer.

Examples of the oil-soluble initiator include pigment dispersants such as 2,2'-azobisisobutyronitrile, 2,2'-azobis-2,4-dimethylvaleronitrile, 1,1'-azobis(cyclohexane-1-carbonitrile) and 2,2'-azobis-4-methoxy-2,4-dimethylvaleronitrile; and peroxide initiators such as acetylcyclohexylsulfonyl peroxide, diisopropylperoxy carbonate, decanonyl peroxide, lauroyl peroxide, stearoyl peroxide, propionyl peroxide, acetyl peroxide, t-butylperoxy-2-ethylhexanoate, benzoyl peroxide, t-butylperoxy isobutyrate, cyclohexanone peroxide, methyl ethyl ketone peroxide, dicumyl peroxide, t-butyl hydroperoxide, di-t-butyl peroxide and cumene hydroperoxide.

Examples of the water-soluble initiator include ammonium persulfate, potassium persulfate, 2,2'-azobis(N,N'-dimethyleneisobutyroamidine)hydrochloride, 2,2'-azobis(2-amidinopropane)hydrochloride, azobis(isobutylamidine)hydrochloride, sodium 2,2'-azobisisobutyronitrilesulfonate, ferrous sulfate and hydrogen peroxide.

To control a degree of polymerization of the polymerizable monomer, a chain transfer agent or a polymerization inhibitor can be further used.

The content of the polymerization initiator is preferably 0.1 parts by mass or more and 20 parts by mass or less, more preferably 0.1 parts by mass or more and 10 parts by mass or less based on 100 parts by mass of the polymerizable monomer.

The polymerizable initiator can be selected with reference to 10-hour half-life temperature. The polymerizable initiator may be used alone or in combination.

In the present invention, a crosslinking agent can also be used during synthesis of the vinyl copolymer as the binder resin to enhance the stress resistance of the toner particles and control the molecular weight of the material for the toner particles.

For the crosslinking agent, a compound having two or more polymerizable double bonds can be used. Examples thereof include aromatic divinyl compounds such as divinylbenzene and divinylnaphthalene; carboxylic acid esters having two double bonds such as ethylene glycol diacrylate, ethylene glycol dimethacrylate and 1,3-butanediol dimethacrylate; divinyl compounds such as divinyl aniline, divinyl ether, divinyl sulfide and divinyl sulfone; and compounds having three or more vinyl groups. These may be used alone or in combination.

The crosslinking agent is used in the range of preferably 0.05 parts by mass or more and 10 parts by mass or less, more preferably 0.1 parts by mass or more and 5 parts by mass or less based on 100 parts by mass of the polymerizable monomer from the viewpoint of the fixability and the offset resistance of the toner.

These polymerizable monomers and crosslinking agents can be used alone or in combination such that the vinyl copolymer as the binder resin has a logical glass transition temperature (Tg) of 40° C. or more and 75° C. or less. A logical glass transition temperature of 40° C. or more barely causes problems in the storage stability and the stress resistance of the toner. A logical glass transition temperature of 75° C. or less barely reduces transparency and low-temperature fixability in formation of full color images in particular.

The aqueous medium used in suspension polymerization can contain a dispersion stabilizer. An inorganic dispersion stabilizer or an organic dispersion stabilizer can be used as the dispersion stabilizer.

Examples of the inorganic dispersion stabilizer include calcium phosphate, magnesium phosphate, aluminum phosphate, zinc phosphate, magnesium carbonate, calcium carbonate, calcium hydroxide, magnesium hydroxide, aluminum hydroxide, calcium metasilicate, calcium sulfate, barium sulfate, bentonite, silica and alumina.

Examples of the organic dispersion stabilizer include polyvinyl alcohol, gelatin, sodium salts of methyl cellulose, methyl hydroxypropyl cellulose, ethyl cellulose, carboxymethyl cellulose and starch.

The dispersion stabilizer can be nonionic surfactants, anionic surfactants and cationic surfactants. Examples of the surfactants include sodium dodecyl sulfate, sodium tetradecyl sulfate, sodium pentadecyl sulfate, sodium octyl sulfate, sodium oleate, sodium laurate, potassium stearate and calcium oleate.

In the present invention, the dispersion stabilizer can be a poorly water-soluble inorganic dispersion stabilizer having solubility in an acid.

When a poorly water-soluble inorganic dispersion stabilizer is used, the poorly water-soluble inorganic dispersion stabilizer can be used in the range of 0.2 parts by mass or more and 2.0 parts by mass or less based on 100 parts by mass of the polymerizable monomer from the viewpoint of the stability of droplets of the polymerizable monomer composition in the aqueous medium.

In the present invention, water can be used in the range of 300 parts by mass or more and 3,000 parts by mass or less based on 100 parts by mass of the polymerizable monomer composition to prepare the aqueous medium.

When an aqueous medium having a poorly water-soluble inorganic dispersion stabilizer dispersed therein is prepared, a commercially available poorly water-soluble inorganic dispersion stabilizer may be used as it is to be dispersed. A dispersion stabilizer containing particles having a uniform fine particle size can be prepared by generating a poorly water-soluble inorganic dispersion stabilizer in water under high-speed stirring. For example, when calcium phosphate is used as the dispersion stabilizer, a sodium phosphate aqueous solution can be mixed with a calcium chloride aqueous solution under high-speed stirring to form particles of calcium phosphate to prepare a preferable, poorly water-soluble inorganic dispersion stabilizer.

In suspension polymerization, a polar resin is added to the polymerizable monomer composition to prepare the toner particles. Thereby, a toner having a core-shell structure having a core containing a binder resin and a release agent and a shell containing a polar resin for coating the core can be prepared.

For this reason, even if the toner particles in the suspension polymerized toner contain a relatively large amount of a release agent, the release agent encapsulated well within the toner particles is barely exposed from the surfaces of the toner particles. As a result, deterioration of the toner can be suppressed even in long-term image output (continuous print).

Examples of the polar resin include polyester, polycarbonate, phenol resin, epoxy resin, polyamide and cellulose. Among these, polyester is preferable.

The polar resin is used in the range of preferably 0.01 parts by mass or more and 20.0 parts by mass or less, more preferably 0.5 parts by mass or more and 10.0 parts by mass or less based on 100 parts by mass of the binder resin.

A pigment is the colorant used for the toner particles contained in the toner according to the present invention, and a dye may be optionally used in combination.

Examples of black colorants include carbon black. Black colorants prepared by mixing the following yellow colorants, magenta colorants and cyan colorants can also be used.

Examples of carbon black include carbon black prepared by a production method such as a thermal method, an acetylene method, a channel method, a furnace method and a lamp black method.

Carbon black has an average particle diameter of primary particles (average primary particle diameter) of preferably 14 nm or more and 80 nm or less, more preferably 25 nm or more and 50 nm or less. At an average particle diameter of primary particles of 14 nm or more, the toner barely looks reddish, and is preferable as the black colorant for forming a full color image. At an average particle diameter of primary particles in carbon black of 80 nm or less, carbon black can be dispersed well in the toner particles, preventing the coloring ability from excessively reducing.

The average particle diameter of primary particles in carbon black is determined based on a photograph enlarged and taken with a scanning electron microscope.

These carbon blacks may be used alone or in combination.

Examples of pigment-based yellow colorants include compounds such as condensation pigments, isoindolinone compounds, anthraquinone compounds, azo metal complex methine compounds and allyl amide compounds. More specifically, examples thereof include C.I. Pigment Yellows 3, 7, 10, 12, 13, 14, 15, 17, 23, 24, 60, 62, 74, 75, 83, 93, 94, 95, 99, 100, 101, 104, 108, 109, 110, 111, 117, 123, 128, 129, 138, 139, 147, 148, 150, 155, 166, 168, 169, 177, 179, 180, 181, 183, 185, 191:1, 191, 192, 193 and 199.

Examples of dye-based yellow colorants include C.I. Solvent Yellows 33, 56, 79, 82, 93, 112, 162 and 163 and C.I. disperse Yellows 42, 64, 201 and 211.

Among these, condensation pigments such as C.I. Pigment Yellows 155 and 180 are preferable because these pigments have a structure similar to the azo skeleton partial structure of the pigment dispersant in the present invention and bring high adsorbability. The pigment dispersant in the present invention can provide strong interaction through a hydrogen bond with the pigment by selection of a substituent. For this reason, the pigment dispersant in the present invention exhibits high adsorbability to an isoindoline compound such as C.I. Pigment Yellow 185 and is preferable.

Examples of pigment-based magenta colorants include condensation pigments, diketo pyrrolo pyrrole compounds, anthraquinone, quinacridone compounds, basic dyelake compounds, naphthol compounds, benzimidazolone compounds, thioindigo compounds and perylene compounds. More specifically, examples thereof include C.I. Pigment Reds 2, 3, 5, 6, 7, 23, 48:2, 48:3, 48:4, 57:1, 81:1, 122, 146, 150, 166, 169, 177, 184, 185, 202, 206, 220, 221, 238, 254 and 269, and C.I. Pigment Violet 19.

Among these, a condensation pigment such as C.I. Pigment Red 150 is preferable because the pigment has a structure similar to the azo skeleton partial structure of the pigment dispersant in the present invention and brings high adsorbability. The pigment dispersant in the present invention can enhance the interaction with the pigment through a hydrogen bond by selection of a substituent. For this reason, the pigment dispersant in the present invention exhibits high adsorbability to quinacridone compounds such as C.I. Pigment Red 122 and C.I. Pigment Violet 19, and is preferable.

Examples of pigment-based cyan colorants include phthalocyanine compounds, derivatives of phthalocyanine compounds, anthraquinone compounds and basic dyelake compounds. More specifically, examples thereof include C.I. Pigment Blues 1, 7, 15, 15:1, 15:2, 15:3, 15:4, 60, 62 and 66.

These pigments as the colorant may be used alone or in combination. Two or more of these may be used in a solid solution state.

The colorant can be selected from the viewpoint of hue angle, chroma, lightness, weatherability, OHT transparency, and dispersibility in the toner particles.

The content of the colorant in the toner particles is preferably 1 part by mass or more and 20 parts by mass or less based on 100 parts by mass of the vinyl copolymer as the binder resin.

In the toner according to the present invention, a preferred mass ratio of the pigment to the pigment dispersant in the toner particles is in the range of 100:0.1 to 100:30, more preferably 100:0.5 to 100:15.

The toner particles in the toner according to the present invention can contain one or more release agents. The total amount of the release agent contained in the toner particles is preferably 2.5% by mass or more and 25.0% by mass or less based on the total mass of the toner particles. The amount is more preferably 4.0% by mass or more and 20% by mass or less, and still more preferably 6.0% by mass or more and 18.0% by mass or less.

Examples of the release agent include: aliphatic hydrocarbon waxes such as low molecular weight polyethylene, low molecular weight polypropylene, microcrystalline waxes, Fischer-Tropsch waxes and paraffin waxes; oxides of aliphatic hydrocarbon waxes such as oxidized polyethylene wax, or block copolymers thereof; waxes containing a fatty acid ester such as carnauba wax and montanic acid ester wax as the main component, or fatty acid esters partially or totally deoxidized such as deoxidized carnauba wax; saturated linear fatty acids such as palmitic acid, stearic acid and montanic acid; unsaturated fatty acids such as planjin acid, eleostearic acid and parinaric acid; saturated alcohols such as stearyl alcohol, aralkylalcohol, behenyl alcohol, carnaubyl alcohol, ceryl alcohol and melissyl alcohol; polyhydric alcohols such as sorbitol; fatty acid amides such as linoleic acid amide, oleamide and lauric acid amide; saturated fatty acid bisamides such as methylene bisstearamide, ethylene biscapric acid amide, ethylene bislauric acid amide and hexamethylene bisstearamide; unsaturated fatty acid amides such as ethylene-bis(oleamide), hexamethylene-bis(oleamide), N,N'-dioleyladipic acid amide and N,N'-dioleylsebacic acid amide; aromatic bisamides such as m-xylene-bis(stearamide) and N,N'-distearylisophthalic acid amide; aliphatic metal salts (usually referred to as metal soap) such as calcium stearate, calcium laurate, zinc stearate and magnesium stearate; aliphatic hydrocarbon waxes grafted with vinyl monomers such as styrene and acrylic acids; partially esterified products of fatty acids such as monoglyceride behenate and polyhydric alcohol; and methyl ester compounds having a hydroxy group and prepared by hydrogenation of vegetable oils and fats.

The toner particles in the toner according to the present invention contain a crystalline polyester resin from the viewpoint of enhancement of low-temperature fixability.

In the present invention, the term "crystalline" means that a resin has a clear endothermic peak determined by differential scanning calorimetry (DSC) described later.

The term "non-crystalline" means that a resin is not found to have a clear endothermic peak.

The crystalline polyester resin has a melting point Tm(C) [° C.] of preferably 55° C. or more and 90° C. or less, more preferably 60° C. or more and 85° C. or less. At a melting point of 55° C. or more, the blocking resistance of the toner barely reduces, preventing inferior storage stability of the toner. At a melting point of 90° C. or less, the solubility of the crystalline polyester resin in the polymerizable monomer barely reduces. The dispersibility of the crystalline polyester resin in the polymerizable monomer barely reduces, suppressing fogging or a reduction in image uniformity.

The crystalline polyester resin in the present invention can be synthesized by polycondensation of an aliphatic dicarboxylic acid with aliphatic diol.

The melting point Tm(C) [° C.] of the crystalline polyester resin can be adjusted according to types of the aliphatic dicarboxylic acid and aliphatic diol used for synthesis or a degree of polymerization.

Examples of the aliphatic dicarboxylic acid used for synthesis of the crystalline polyester resin include oxalic acid, malonic acid, succinic acid, glutaric acid, adipic acid, pimelic acid, suberic acid, glutaconic acid, azelaic acid, sebacic acid, nonanedicarboxylic acid, decanedicarboxylic acid, undecanedicarboxylic acid, dodecanedicarboxylic acid, maleic acid, fumaric acid, mesaconic acid, citraconic acid, itaconic acid, isophthalic acid, terephthalic acid, n-dodecylsuccinic acid, n-dodecenylsuccinic acid, cyclohexanedicarboxylic acid, or anhydrides or lower alkyl esters thereof.

Besides of the acid component, polyvalent carboxylic acids having a valence of 3 or more may be used.

Examples of the polyvalent carboxylic acids having a valence of 3 or more include trimellitic acid, 2,5,7-naphthalenetricarboxylic acid, 1,2,4-naphthalenetricarboxylic acid, pyromellitic acid, 1,2,4-butanetricarboxylic acid, 1,2,5-hexanetricarboxylic acid, 1,3-dicarboxyl-2-methyl-2-methylenecarboxypropane, or derivatives of acid anhydrides or lower alkyl esters thereof.

These may be used alone or in combination.

Examples of the aliphatic diols used in synthesis of the crystalline polyester resin include ethylene glycol, diethylene glycol, triethylene glycol, 1,2-propylene glycol, 1,3-propylene glycol, dipropylene glycol, trimethylene glycol, tetramethylene glycol, pentamethylene glycol, hexamethylene glycol, octamethylene glycol, nonamethylene glycol, decamethylene glycol, neopentyl glycol and 1,4-butadiene glycol.

Besides the alcohol components, the followings may be used, for example: divalent alcohols such as polyoxyethylated bisphenol A, polyoxypropylenated bisphenol A and 1,4-cyclohexanedimethanol; aromatic alcohols such as 1,3,5-trihydroxymethylbenzene; and trivalent alcohols such as pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane and trimethylolpropane.

Examples of alcohols having a valence of 3 or more include glycerol, trimethylolethane, trimethylolpropane and pentaerythritol.

These may be used alone or in combination.

The crystalline polyester resin can be a polyester resin synthesized by polycondensation of an aliphatic dicarboxylic acid represented by Formula (4) (linear aliphatic dicarboxylic acid) and an aliphatic diol represented by Formula (5) (linear aliphatic diol):

$$HOOC—(CH_2)_m—COOH \quad (4)$$

where m represents an integer of 4 or more and 16 or less;

$$HO—(CH_2)_n—OH \quad (5)$$

where n represents an integer of 4 or more and 16 or less.

A linear aliphatic dicarboxylic acid and a linear aliphatic diol attain excellent crystallinity of the polyester resin to provide a proper melting point of the crystalline polyester resin, so that the toner is excellent in blocking resistance, image storage stability and low-temperature fixability. At a number of carbon atoms (m and n) of 4 or more, the polyester resin has a proper melting point, so that the toner is excellent in blocking resistance, image storage stability and low-temperature fixability. At a number of carbon atoms (m and n) of 16 or less, materials are easily available. The number of carbon atoms (m and n) is more preferably 14 or less.

From the viewpoint of crystallinity of the crystalline polyester resin, the content of the aliphatic dicarboxylic acid contained in the polycarboxylic acid component used for synthesis of the polyester resin is preferably 80 mol % or more. The content is more preferably 90 mol % or more, still more preferably 100 mol %.

From the viewpoint of crystallinity of the crystalline polyester resin, the content of the aliphatic diol component contained in the polyol component used for synthesis of the polyester resin is preferably 80 mol % or more. The content is more preferably 90 mol % or more, still more preferably 100 mol %.

In synthesis of the crystalline polyester resin, a monovalent acid such as acetic acid and benzoic acid, or a monohydric alcohol such as cyclohexanol benzyl alcohol can also be used from the viewpoint of adjustment of the acid value and the hydroxyl value of the crystalline polyester resin.

The crystalline polyester resin can be a saturated polyester. Unlike a crystalline polyester resin having an unsaturated portion, the saturated polyester does not cause a crosslinking reaction in the reaction with a peroxide polymerization initiator. This property is advantageous in the solubility of the crystalline polyester resin in the polymerizable monomer. The crystalline polyester resin in the present invention can be synthesized, for example: first, a dicarboxylic acid component is reacted with a dialcohol component by an esterification reaction or a transesterification reaction. Subsequently, the reaction product is polycondensed according to the standard method under reduced pressure or while nitrogen gas is being introduced.

In the esterification or transesterification reaction, an esterification catalyst or an ester exchange catalyst such as sulfuric acid, tertiary butyl titanium butoxide, dibutyltin oxide, manganese acetate and magnesium acetate can be used. A polymerization catalyst such as tertiary butyl titanium butoxide, dibutyltin oxide, tin acetate, zinc acetate, tin disulfide, antimony trioxide and germanium dioxide can be used for polymerization.

For the polymerization catalyst, a titanium catalyst (catalyst containing titanium) is preferably used, and a chelate type titanium catalyst is more preferably used. This is because the titanium catalyst has proper reactivity to attain a suitable molecular weight distribution of the polyester resin. The crystalline polyester resin synthesized with the titanium catalyst attains excellent chargeability of the toner because titanium or the titanium catalyst is taken into the polyester resin during synthesis. In particular, the chelate type titanium catalyst attains these effects significantly. The chelate type titanium catalyst is hydrolyzed during the reaction, and is taken into the polyester resin to properly control the hydrogen drawing reaction from the peroxide polymerization initiator. The durability of the toner is also improved.

The acid value of the crystalline polyester resin can be controlled by capping a carboxy group in the terminal of the polymer. The terminal can be capped with monocarboxylic acid or monoalcohol, for example.

Examples of monocarboxylic acid include monocarboxylic acids such as benzoic acid, naphthalenecarboxylic acid, salicylic acid, 4-methylbenzoic acid, 3-methylbenzoic acid, phenoxyacetic acid, biphenylcarboxylic acid, acetic acid, propionic acid, butyric acid, octanoic acid, decanoic acid, dodecanoic acid and stearic acid.

Examples of monoalcohol include monoalcohols such as methanol, ethanol, propanol, isopropanol, butanol and higher alcohol.

In the present invention, the crystalline polyester resin includes modified crystalline polyester resins having a crystalline polyester site bonded to a site other than the crystalline polyester site (copolymerization site). The copolymerization site can be 60% by mass or less based on the total mass of the modified crystalline polyester resin. The crystalline polyester resin is also referred to as a hybrid crystalline polyester resin.

The toner particles in the toner according to the present invention contain the vinyl copolymer as the binder resin. When the crystalline polyester resin also has the copolymerization site, the copolymerization site can be a non-crystalline vinyl polymer site.

The non-crystalline vinyl polymer site as the copolymerization site can improve the miscibility of the crystalline polyester resin with the vinyl copolymer as the binder resin to finely disperse the crystalline polyester resin in the toner particles. Thereby, further excellent low-temperature fixability and durability of the toner can be attained.

When the crystalline polyester resin is melt in the fixing step, the crystalline polyester resin having non-crystalline vinyl polymer site can be miscible with the binder resin which is also a vinyl copolymer to sufficiently plasticize the binder resin. For this reason, low-temperature fixability can be further improved.

At a mass of the non-crystalline vinyl polymer site in the crystalline polyester resin of 60% by mass or less, the miscibility between the crystalline polyester resin and the binder resin is difficult to excessively progress, and the blocking resistance of the toner barely reduces. The degree of crystallization of the crystalline polyester resin barely reduces, exhibiting high sharp-melting properties in the fixing step.

In the crystalline polyester resin in the present invention, the content of an ester group in the crystalline polyester resin can also be adjusted to enhance miscibility with the vinyl copolymer as the binder resin. Namely, an increased content of the ester group in the crystalline polyester resin can enhance the miscibility with the binder resin (vinyl copolymer).

An increased content of the ester group in the crystalline polyester resin may reduce the melting point Tm(C) [° C.] of the crystalline polyester resin to reduce the blocking resistance and image storage stability of the toner. The content of the ester group needs to be adjusted in consideration of the glass transition temperature (Tg).

The crystalline polyester resin has a weight average molecular weight (Mw) of preferably 10,000 or more and 80,000 or less, more preferably 13,000 or more and 40,000 or less. At a weight average molecular weight (Mw) of the crystalline polyester resin of 10,000 or more and 80,000 or less, the degree of crystallization of the crystalline polyester resin can be kept high in the step of producing the toner. A plasticizing effect by the crystalline polyester resin can be quickly attained in the fixing step. For this reason, excellent heat-resistant storage stability, and excellent fixability under low temperature conditions and high-speed conditions can be satisfied at the same time.

The weight average molecular weight (Mw) of the crystalline polyester resin can be controlled by various conditions for preparing the crystalline polyester resin. The method for determining the weight average molecular weight (Mw) of the crystalline polyester resin will be described later.

When the crystalline polyester resin has the non-crystalline vinyl polymer site, the non-crystalline vinyl polymer site can have a weight average molecular weight (Mw) of 2,000 or more and 12,000 or less. At a weight average molecular weight (Mw) of the non-crystalline vinyl polymer site of 2,000 or more and 12,000 or less, the crystalline polyester resin is more readily uniformly dispersed in the vinyl copolymer as the binder resin. As a result, the miscibility of the crystalline polyester resin with the binder resin is further improved to attain further improved low-temperature fixability. The weight average molecular weight (Mw) of the non-crystalline vinyl polymer site can be controlled by various production conditions for polyester such as the amount of a double-reactive monomer to be added during preparation of the crystalline polyester resin. The method for determining the weight average molecular weight (Mw) of the non-crystalline vinyl polymer site will be described later.

The acid value of the crystalline polyester resin can be 5.0 mgKOH/g or less. At an acid value of the crystalline polyester resin of 5.0 mgKOH/g or less, the crystalline polyester resin is barely localized in the binder resin, so that the crystalline polyester resin is properly dispersed. For this reason, a sufficient plasticizing effect on the binder resin by the crystalline polyester resin can be attained to provide excellent low-temperature fixability. The degree of crystallization of the crystalline polyester resin can be increased to improve the heat resistance of the toner.

An reduction in the acid value of the crystalline polyester resin improves the adhesiveness between the toner and paper during image formation.

In preparation of the toner particles by suspension polymerization, the crystalline polyester resin having an acid value of 5.0 mgKOH/g or less barely causes aggregation of the toner particles. As a result, the charge stability and the long-term stability of the toner are improved.

The acid value of the crystalline polyester resin can be controlled according to the ratio of the alcohol component to the acid component that forms the crystalline polyester resin, types of monomers, and treatment of the terminal group of the crystalline polyester resin. The method for determining the acid value of the crystalline polyester resin will be described later.

The content of the crystalline polyester resin in the toner particles is preferably 3 parts by mass or more and 50 parts by mass or less, more preferably 3.0 parts by mass or more and 20 parts by mass or less based on 100 parts by mass of the vinyl copolymer as the binder resin in the toner particles.

At a content of the crystalline polyester resin of 3 parts by mass or more, low-temperature fixability is further improved. Although the crystalline polyester resin readily absorbs moisture, the crystalline polyester resin contained in a content of 50 parts by mass or less barely reduces the charging uniformity of the toner and causes fogging. The crystalline polyester resin contained in a content of 50 parts by mass or less barely reduces melt viscosity due to the presence of the excessive crystalline polyester resin, thus preventing offset. The suspension polymerized toner barely reduces the smoothness of the shapes of the surfaces of the toner particles, thus preventing a reduction in the chargeability of the toner or in image density.

In a polymerization step (step of polymerizing the polymerizable monomer) in preparation of the toner, the toner particles are more preferably heated and kept at Temperature T1 (° C.) shown in Expression (26):

$$T1\ [°\ C.] \geq Tm(C)\ [°\ C.] + 5\ [°\ C.] \quad (26)$$

where Tm represents the melting point [° C.] of the crystalline polyester resin.

The toner particles are kept (heated and kept) at a temperature equal to or more than the melting point Tm(C) [° C.] of the crystalline polyester resin in the polymerization step during preparation of the toner, thereby to sufficiently melt the crystalline polyester resin and progress miscibility with the vinyl copolymer as the binder resin. As a result, the fine dispersibility of the crystalline polyester resin in the binder resin is improved to improve low-temperature fixability. T1 is more preferably equal to or 10° C. higher than Tm(C) [° C.].

The toner particles, after the polymerization step during preparation of the toner, can be kept (heated and kept, and annealed) at Temperature T2 (° C.) shown in Expression (27) for 60 or more minutes:

$$\text{Tm(C) [° C.]} - 30 \text{ [° C.]} \leq T2 \text{ [° C.]} \leq \text{Tm(C) [° C.]} - 5 \text{ [° C.]} \quad (27)$$

The crystalline polyester resin is prone to be partially non-crystallized during preparation of the toner to reduce the degree of crystallization. The non-crystallized crystalline polyester resin may be miscible with the vinyl copolymer as the binder resin to soften the binder resin. After the polymerization step during preparation of the toner, the toner particles are kept (heated and kept) at Temperature T2 shown in Expression (27) for 60 minutes or more to improve the degree of crystallization of the crystalline polyester resin. Namely, even if the crystalline polyester resin is finely dispersed in the binder resin, crystallinity can be sufficiently kept to attain excellent fixability while the heat-resistant storage stability and the durability of the toner are sufficiently kept.

The dispersion state of the crystalline polyester resin in the toner can be controlled according to physical properties such as the acid value and the molecular weight of the crystalline polyester resin and the conditions such as the melting point and the polymerization temperature of the crystalline polyester resin.

Examples of the method of preparing a hybrid crystalline polyester resin having a crystalline polyester site and a non-crystalline vinyl polymer site include a method for progressing a polymerization reaction under an increased pressure environment in preparation of the non-crystalline vinyl polymer site. Specifically, when the non-crystalline vinyl polymer is a polymer composed of a (meth)acrylic acid ester, examples thereof include a transesterification reaction of a hydroxy group contained in the polyester with a (meth) acrylic acid ester contained in the non-crystalline vinyl polymer. When the non-crystalline vinyl polymer has a carboxy group, examples thereof include an esterification reaction of a hydroxy group contained in the polyester with a carboxy group contained in the non-crystalline vinyl polymer. When the non-crystalline vinyl polymer has a hydroxy group, examples thereof include an esterification reaction of a carboxy group contained in the polyester with a hydroxy group contained in the non-crystalline vinyl polymer. Examples thereof include a method of generating radicals in the polyester by a hydrogen drawing reaction, adding a vinyl monomer, and polymerizing the mixture under an increased pressure environment. At this time, the pressure can be increased 0.20 MPa or more and 0.45 MPa or less.

Examples of the vinyl polymerizable monomer used in preparation of the hybrid crystalline polyester resin having a crystalline polyester site and a non-crystalline vinyl polymer site include monofunctional polymerizable monomers and polyfunctional polymerizable monomers.

Examples of the monofunctional polymerizable monomers include styrene/styrene derivatives (styrene monomers) such as styrene, α-methylstyrene, o-methylstyrene, m-methylstyrene and p-methylstyrene; acrylic polymerizable monomers such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate and cyclohexyl acrylate; and methacrylic polymerizable monomers such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate and cyclohexyl methacrylate.

Examples of the polyfunctional polymerizable monomers include acrylic polyfunctional polymerizable monomers such as diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis(4-(acryloxydiethoxy)phenyl)propane, trimethylolpropane triacrylate and tetramethylolmethane tetraacrylate; methacrylic polyfunctional polymerizable monomers such as diethylene glycol dimethacrylate, triethylene glycol dimethacrylate, tetraethylene glycol dimethacrylate, polyethylene glycol dimethacrylate, 1,6-hexanediol dimethacrylate, neopentyl glycol dimethacrylate, tripropylene glycol dimethacrylate, polypropylene glycol dimethacrylate, 2,2'-bis(4-(methacryloxydiethoxy)phenyl) propane, trimethylolpropane trimethacrylate and tetramethylolmethane tetramethacrylate; and divinylbenzene, divinylnaphthalene and divinyl ether.

Vinyl monomers having a carboxy group and a hydroxy group can be used. The vinyl monomer can contain at least one (meth)acrylic acid ester. A carboxy group, which is a functional group having strong polarity, in the non-crystalline vinyl polymer site of the hybrid crystalline polyester resin will provide proper polarity of the non-crystalline vinyl polymer site. This effect of the polarity can stabilize the toner particles in the aqueous medium during preparation of the toner.

If the non-crystalline vinyl polymer site of the hybrid crystalline polyester resin is a copolymer of acrylic acid, the hydrogen bond with a carboxy group in acrylic acid attains firm surfaces of the toner particles to improve the durability of the toner. The content of acrylic acid in the hybrid crystalline polyester resin can be 3.0% by mass or less to suppress a reduction in frictional chargeability of the toner caused by enhanced hygroscopicity of the toner under a high temperature and high humidity environment.

In preparation of the hybrid crystalline polyester resin, examples of a polymerization initiator used to polymerize a polymerizable monomer include oil-soluble initiators and water-soluble initiators.

Examples of the oil-soluble initiators include azo compounds such as 2,2'-azobisisobutyronitrile; and peroxides such as t-butylperoxy neodecanoate, t-hexylperoxy pivalate, lauroyl peroxide, t-butylperoxy 2-ethylhexanoate, t-butylperoxy isobutyrate, di-t-butylperoxy isophthalate and di-t-butyl peroxide.

Examples of the water-soluble initiators include ammonium persulfate, potassium persulfate, 2,2'-azobis(N,N'-dimethyleneisobutyroamidine)hydrochloride, 2,2'-azobis(2-amidinopropane)hydrochloride, azobis(isobutylamidine) hydrochloride, sodium 2,2'-azobisisobutyronitrilesulfonate, 2,2'-azobis{2-methyl-N-[1,1-bis(hydroxymethyl)-2-hydroxyethyl]propionamide}, 2,2'-azobis{2-methyl-N-[2-(1-hydroxybutyl)]-propionamide}, hydrochlorideferrous sulfate and hydrogen peroxide.

Among these polymerization initiators, peroxides can be used.

When the polyester resin is vinyl modified by a hydrogen drawing reaction to prepare the hybrid crystalline polyester resin, the 10-hour half-life temperature of the polymerization initiator is preferably 70° C. or more and 170° C. or less. The temperature is more preferably 75° C. or more and 130° C. or less.

From the viewpoint of a reduction in the environmental dependency of the chargeability of the toner and stabilization of the chargeability of the toner, the toner particles can contain a charge-controlling agent.

Examples of negative charging charge-controlling agents include monoazo metal compounds; acetylacetone metal compounds; aromatic oxycarboxylic acids, aromatic dicarboxylic acids, oxycarboxylic acid, dicarboxylic acid metal compounds, aromatic oxycarboxylic acids and aromatic mono- or polycarboxylic acids; metal salts thereof, anhydrides thereof, esters thereof, phenol derivatives thereof such as bisphenol derivatives thereof and urea derivatives thereof; metal-containing salicylic acid compounds; metal-containing naphthoic acid compounds; boron compounds; quaternary ammonium salts; calixarene; and resin charge controllers.

Examples of positive charging charge-controlling agents include nigrosine modified products modified with nigrosine or fatty acid metallic salts; guanidine compounds; imidazole compounds; quaternary ammonium salts such as tributylbenzylammonium 1-hydroxy-4-naphthosulfonate and tetrabutylammonium tetrafluoroborate, or onium salts such as phosphonium salts that are analogs thereof, or lake pigments thereof; triphenylmethane dyes, or lake pigments thereof (laking agents such as phosphorus tungstate, phosphorus molybdate, phosphorus tungsten molybdate, tannic acid, lauric acid, gallic acid, ferricyanide and ferrocyanide); metal salts of higher fatty acids; diorganotin oxides such as dibutyltin oxide, dioctyltin oxide and dicyclohexyltin oxide; diorganotin borates such as dibutyltin borate, dioctyltin borate and dicyclohexyltin borate; and resin charge controllers.

These charge-controlling agents may be used alone or in combination.

Among these charge-controlling agents, metal-containing salicylic acid compounds are preferable, and those containing aluminum or zirconium as the metal are more preferable as charge-controlling agents other than the resin charge controllers. Among these, aluminum salicylate compounds are more preferable.

Preferably resin charge controllers are polymers or copolymers having a sulfonic acid group, a sulfonic acid salt group or a sulfonic acid ester group.

The content of the charge-controlling agent in the toner particles is preferably 0.01 parts by mass or more and 20.00 parts by mass or less based on 100.00 parts by mass of the vinyl copolymer as the binder resin or the polymerizable monomer for preparing the vinyl copolymer. The content is more preferably 0.05 parts by mass or more and 10.00 parts by mass or less.

The toner according to the present invention can have inorganic fine particles (inorganic fine powder) on the surfaces of the toner particles. The inorganic fine particles are mixed with the toner particles for an improvement in the fluidity of the toner and uniform charging. Most of the mixed inorganic fine particles present in the toner particles adhere to the surfaces of the toner particles.

The number average particle diameter (D1) of primary particles of the inorganic fine particle can be 4 nm or more and 500 nm or less.

Examples of the inorganic fine particles include silica, alumina, titania and composite oxides thereof. Examples of composite oxides include silica aluminum fine particles and strontium titanate fine particles.

These inorganic fine particles can be used after the surfaces thereof are hydrophobized.

The toner may further contain other additives.

Examples of other additives include lubricant particles such as polytetrafluoroethylene (such as Teflon (trade name)) particles, zinc stearate particles and polyfluorovinylidene particles; polishing agents such as cerium oxide particles, silicon carbide particles and strontium titanate particles; fluidizing agents such as titanium oxide particles and aluminum oxide particles; anticaking agents; and developability improvers such as organic fine particles and inorganic fine particles having opposite polarity.

These additives can also be used after the surfaces thereof are hydrophobized.

The toner according to the present invention can be used in one-component developing type image forming apparatuses and two-component developing type image forming apparatuses.

(Method for Determining Rate of Adsorption of Pigment Dispersant to Pigment)

The rate of adsorption of the pigment dispersant to the pigment was determined as follows.

Creation of Calibration Curve (A) A pigment dispersant (10% by mass based on the pigment) is added to prepare a polymerizable monomer composition having the same formula as that of the toner to be measured (excluding the pigment dispersant). A solution (5 mL) of a polymerizable monomer and a pigment dispersant (Solution 1) is prepared by mixing the polymerizable monomer and the pigment dispersant such that the ratio of the polymerizable monomer (dispersion medium) to the pigment dispersant is the same as that in the polymerizable monomer composition. A polymerizable monomer is added to Solution 1, and is diluted to ⅕and 1/10to prepare solutions (Solution 2, Solution 3).

(B) Solutions 1, 2 and 3 are settled at 25° C. for 24 hours, and are filtered with a solvent-resistant membrane filter having a pore diameter of 0.2 μm to prepare sample solutions. The content of the pigment dispersant in each sample solution is measured by GPC (gel permeation chromatography) on the following conditions. Based on the results of measurement, the calibration curve of the content (g/mL) of the pigment dispersant in the polymerizable monomer (dispersion medium) is created. apparatus: high-speed GPC apparatus (trade name: HLC-8220 GPC, manufactured by Tosoh Corporation)

column: two columns of LF-804 eluent: THF (tetrahydrofuran)

flow rate: 1.0 mL/min oven temperature: 40° C.

amount of the sample to be injected: 0.025 mL

Determination of Adsorption Rate (A) A pigment dispersant (10.0% by mass based on the pigment) is added to prepare a polymerizable monomer composition having the same formula as that of the toner to be measured (excluding the pigment dispersant). The polymerizable monomer composition is settled at 25° C. for 24 hours. Subsequently, the polymerizable monomer composition is centrifuged on the following conditions:

apparatus: high-speed centrifuge (trade name: H-9R, manufactured by Kokusan Co., Ltd.)

centrifuge tube: PPT-010 sample: composition having a volume of about 80% based on the volume of the centrifuge tube is injected centrifuge condition: 3 minutes at 10,000 rpm (25° C.)

(B) A supernatant of the centrifuged composition is collected, and is filtered with a filter (manufactured by Nihon Millipore K.K., Millex LH, pore diameter: 0.45 μm, diameter: 13 mm). The content of the pigment dispersant in the filtered supernatant solution is measured with GPC on the same conditions when the calibration curve is created.

(C) From the results of measurement, the adsorption rate is calculated from the following expression:

adsorption rate (%)=(1−((content of pigment dispersant in Solution 1 (g/mL))−(content of pigment dispersant in supernatant solution of composition (g/mL)))/(content of pigment dispersant in Solution 1 (g/mL)))×100

(Method for Determining Acid Value of Pigment Dispersant)

The acid value of the pigment dispersant is determined as follows.

The acid value is defined as a numeric value (mg) of potassium hydroxide needed to neutralize a resin acid or the like contained in 1 g of a sample, and is determined by the following test.

The acid value of the binder resin is determined according to JIS K 0070-1992. Specifically, the measurement is performed by the following procedure.

(1) Preparation of Reagent

Phenolphthalein (1.0 g) is dissolved in ethyl alcohol (95% by volume, 90 mL), and ion exchange water is added to prepare 100 mL phenolphthalein solution.

Super grade potassium hydroxide (7 g) is dissolved in water (5 mL), and ethyl alcohol (95% by volume) is added to prepare 1 L solution. The solution is placed in an alkali-resistant container to avoid contacting with carbon dioxide gas or the like, and is settled for 3 days. The solution is filtered to prepare a potassium hydroxide solution. The potassium hydroxide solution is preserved in an alkali-resistant container. The factor of the potassium hydroxide solution is determined as follows: 0.1 mol/L hydrochloric acid (25 mL) is placed in a conical flask, and several drops of the phenolphthalein solution are added; the solution is titrated with the potassium hydroxide solution to determine the factor of the potassium hydroxide solution from the volume of the potassium hydroxide solution needed for neutralization. The 0.1 mol/L hydrochloric acid used is prepared according to JIS K 8001-1998.

(2) Operation (A) Main Test

A sample (2.0 g) of a crushed binder resin is precisely weighed and placed in a 200 mL conical flask, and a mixed solution (100 mL) of toluene/ethanol (2:1) is added to dissolve the sample over 5 hours. Several drops of the phenolphthalein solution are then added as an indicator to titrate the solution with the potassium hydroxide solution. The end point of titration is defined as a point of time when a light red color of the indicator continuously appears for about 30 seconds.

(B) Blank Test

Titration is performed in the same manner as above except that the sample is not used (namely, only the mixed solution of toluene/ethanol (2:1) is used).

(3) The results are substituted into the following expression to calculate the acid value:

$$A=[(C-B)\times f\times 5.61]/S$$

where A represents an acid value (mgKOH/g); B represents the amount of potassium hydroxide solution to be added (mL) in the blank test; C represents the amount of potassium hydroxide solution to be added (mL) in the main test; f represents a factor of the potassium hydroxide solution; S represents a mass (g) of the sample.

(Method for Determining Amine Value of Pigment Dispersant)

The amine value is defined as a numeric value (mg) of the amount of potassium hydroxide equivalent to the amount of perchloric acid needed to neutralize the total amount of amine contained in the sample (1 g).

The amine value of the pigment dispersant is determined according to JIS K 7237-1995. Specifically, the measurement is performed by the following procedure.

(1) Preparation of Reagent

Crystal violet (0.1 g) is dissolved in acetic acid (100 mL) to prepare a crystal violet solution.

Perchloric acid (8.5 mL) is slowly added to a premixed solution of acetic acid (500 mL) and acetic anhydride (200 mL), and these are mixed. Acetic acid is added to the mixed solution (1 L in total), and is settled for 3 days to prepare a perchloric acid/acetic acid solution.

The factor of the perchloric acid/acetic acid solution is determined by the following procedure.

First, phthalic acid hydrogen potassium (1 mg) is weighed, and is dissolved in acetic acid (20 mL); o-nitrotoluene (90 mL) is added, and several drops of the crystal violet solution are added. The solution is titrated with the perchloric acid/acetic acid solution.

(2) Operation (A) Main Test

A sample (2.0 g) is precisely weighed and placed in a 200 mL beaker, and a mixed solution of o-nitrotoluene/acetic acid (9:2) (100 mL) is added. The sample is dissolved over 3 hours. Several drops of the crystal violet solution are then added, and the solution is titrated with the perchloric acid/acetic acid solution. The end point of titration is defined as a point of time when the color of the indicator changes from blue to green and the color of green continuously appears for about 30 seconds.

(B) Blank Test

The test is performed in the same manner as above except that the sample is not used (namely, only the mixed solution of o-nitrotoluene/acetic acid (9:2) is used).

(3) Calculation of Total Amine Value

The results are substituted into the following expression to calculate the amine value AmV:

$$AmV=[(D-C)\times f\times 5.61]/S$$

where AmV represents an amine value (mgKOH/g); C represents the amount of the perchloric acid/acetic acid solution to be added (mL) in the blank test; D represents the amount of the perchloric acid/acetic acid solution to be added (mL) in the main test; f represents a factor of the perchloric acid/acetic acid solution; S represents a mass (g) of the sample.

(Method for Determining Number Average Molecular Weight of Polymer Component and Pigment Dispersant)

The molecular weights of a variety of polymer sites and the compound having azo skeleton partial structure according to the present invention are calculated in terms of polystyrene by size exclusion chromatography (SEC). The molecular weight is determined by SEC as follows.

A sample is added to an eluent such that the content of the sample is 1.0%. The solution is settled at room temperature for 24 hours, and is then filtered with a solvent-resistant membrane filter having a pore diameter of 0.2 μm to prepare a sample solution. The sample solution is measured on the following conditions:

apparatus: high-speed GPC apparatus (trade name: HLC-8220GPC, manufactured by Tosoh Corporation)
column: two columns of LF-804
eluent: THF (tetrahydrofuran)
flow rate: 1.0 mL/min
oven temperature: 40° C.
amount of the sample to be injected: 0.025 mL In calculation of the molecular weight of the sample, molecular weight calibration curves created from standard polystyrene resins (manufactured by Tosoh Corporation, TSK Standard Polystyrenes F-850, F-450, F-288, F-128, F-80, F-40, F-20, F-10, F-4, F-2, F-1, A-5000, A-2500, A-1000 and A-500) are used.

(Determination of Average Particle Diameter and Particle Size Distribution of Toner)

For the average particle diameter and particle size distribution of the toner, the number distribution and the weight distribution are calculated with a Coulter Counter TA-III (manufactured by Beckman Coulter, Inc.). The weight average particle diameter (D4) and the number average particle diameter (D1) of the toner are calculated as follows.

The measurement apparatus used is a precise particle size distribution measurement apparatus (trade name: Coulter Counter Multisizer 3, manufactured by Beckman Coulter, Inc.) according to a pore electric resistance method including an aperture tube of 100 μm. The measurement conditions are set and the data obtained by the measurement is analyzed with an attached, dedicated software "Beckman Coulter Multisizer 3 Version 3.51" (manufactured by Beckman Coulter, Inc.). The measurement is performed with 25,000 effective measurement channels.

An aqueous electrolyte, such as ISOTON II (trade name) manufactured by Beckman Coulter, Inc. can be used for the measurement. The solution is prepared by dissolving super grade sodium chloride in ion exchange water such that the content is about 1% by mass.

Before the measurement and analysis, the dedicated software is set as follows.

In the window "Changing Standard Operating Method (SOM)" of the dedicated software, the total count number in a control mode is set to 50,000 particles, the number of measurement is set to once, and a Kd value is set to a value obtained by using "Standard Particles: 10.0 μm" (manufactured by Beckman Coulter, Inc.). The "Threshold/Measure Noise Level button" is pressed to automatically set the threshold and the noise level. The current is set to 1600 μA, the gain is set to 2, and the electrolytic solution is set to "ISOTON II." "Flush Aperture Tube after each run" is checked.

In the window "Convert Pulses to Size" of the dedicated software, the bin interval is set to the logarithmic particle diameter, the particle diameter bin is set to 256 particle diameter bins, and the particle diameter range is set from 2 μm to 60 μm.

The specific measurement method will be described below.

(1) The aqueous electrolyte (about 200 mL) is placed in a Multisizer 3-dedicated 250 mL round-bottomed glass beaker. The beaker is set on a sample stand, and the solution is stirred counterclockwise with a stirrer rod at 24 rotations/sec. Dirt and air bubbles are removed from the aperture tube by the "Flush aperture" function of the dedicated software.

(2) The aqueous electrolyte (about 30 mL) is placed in a 100 mL glass flat-bottomed beaker. A diluted solution (about 0.3 mL) of a dispersant diluted about 3 mass times with ion exchange water is added to the aqueous electrolyte. The dispersant is "CONTAMINON N" (10% by mass aqueous solution of a neutral detergent (pH: 7) for washing a precision measurement apparatus, including a nonionic surfactant, an anionic surfactant, and an organic builder, manufactured by Wako Pure Chemical Industries, Ltd.).

(3) Two oscillators having an oscillating frequency of 50 kHz are incorporated with the phase of one oscillator being 1800 from the phase of the other. An ultrasonic disperser having an electrical output of 120 W (trade name: Ultrasonic Dispersion System Tetora 150, manufactured by Nikkaki-Bios Co., Ltd.) is prepared. A predetermined amount of ion exchange water is placed in a water bath of the ultrasonic disperser, and the CONTAMINON N (about 2 mL) is added to the water bath.

(4) The beaker in (2) is set on a beaker fixing hole in the ultrasonic disperser to operate the ultrasonic disperser. The vertical position of the beaker is adjusted such that the resonant state of the solution surface of the aqueous electrolyte in the beaker reaches maximum.

(5) While the aqueous electrolyte in the beaker in (4) is irradiated with ultrasonic waves, the toner (about 10 mg) is added to the aqueous electrolyte little by little to be dispersed. When the granulation properties of the toner particles are checked, a toner particle suspension after termination of the polymerization reaction is added to the aqueous electrolyte little by little to be dispersed. The dispersion treatment with ultrasonic wave is continued for another 60 seconds. In ultrasonic dispersion, the temperature of water in the water bath is adjusted so as to be 10° C. or more and 40° C. or less.

(6) The aqueous electrolyte in (5) having the toner dispersed is dropped into the round-bottomed beaker in (1) set on the sample stand with a pipette, and is adjusted such that the concentration in measurement is about 5%. The measurement is performed until 50,000 particles are measured.

(7) The measurement data is analyzed with the dedicated software attached to the apparatus to calculate the weight average particle diameter (D4) and the number average particle diameter (D1). The weight average particle diameter (D4) is "average diameter" displayed in the window "Analyze/Volume Statistics (Arithmetic)" when graph/volume % is set in the dedicated software. The number average particle diameter (D1) is "average diameter" displayed in the window "Analysis/the number statistical value (Arithmetic)" when graph/% by number is set in the dedicated software.

The granulation properties in the granulating step (step of forming particles of the polymerizable monomer composition) are examined based on D50% by weight/D50% by number determined by a Coulter Counter. D50% by volume/D50% by number is 50% particle diameter based on weight distribution/50% particle diameter based on the number distribution.

(Weight Average Molecular Weight of Crystalline Polyester Resin)

After the crystalline polyester resin (0.03 g) is dispersed and dissolved in o-dichlorobenzene (10 mL), the solution is shaken at 135° C. for 24 hours with a shaker, and is filtered with a 0.2 μm filter. The filtrate is used as a sample, and is analyzed on the following conditions:

(Analysis Conditions)

separation column: Shodex (TSK GMHHR-H HT20)×2
column temperature: 135° C.
mobile phase solvent: o-dichlorobenzene
mobile phase flow rate: 1.0 mL/min
sample concentration: about 0.3%
amount of injection: 300 μL
detector: differential refractive index detector Shodex RI-71

In calculation of the molecular weight of the sample, molecular weight calibration curves created from standard polystyrene resins (manufactured by Tosoh Corporation, TSK Standard polystyrenes F-850, F-450, F-288, F-128, F-80, F-40, F-20, F-10, F-4, F-2, F-1, A-5000, A-2500, A-1000 and A-500) are used.

(Weight Average Molecular Weight of Non-Crystalline Vinyl Polymer Site in Crystalline Polyester Resin)

The molecular weight of the non-crystalline vinyl polymer site in the crystalline polyester resin is measured by hydrolyzing the crystalline polyester site of the crystalline polyester resin.

Specifically, dioxane (5 mL) and 10% by mass potassium hydroxide aqueous solution (1 mL) are added to the crystalline polyester resin (30 mg). The solution is shaken at 70° C. for 6 hours to hydrolyze the crystalline polyester site. Subsequently, the solution is dried to prepare a sample for measurement of the molecular weight of the non-crystalline vinyl polymer site.

The sample for measurement (0.03 g) is dispersed and dissolved in o-dichlorobenzene (10 mL), and is shaken at 135° C. for 24 hours with a shaker. The sample is filtered with a 0.2 μm filter. The filtrate is used as a sample to be analyzed on the following conditions:

(Analysis Condition)

separation column: Shodex (TSK GMHHR-H HT20)×2
column temperature: 135° C.
mobile phase solvent: o-dichlorobenzene
mobile phase flow rate: 1.0 mL/min
sample concentration: about 0.3%
amount of injection: 300 μL
detector: differential refractive index detector Shodex RI-71

In calculation of the molecular weight of the sample, molecular weight calibration curves created from standard polystyrene resins (manufactured by Tosoh Corporation, TSK Standard polystyrenes F-850, F-450, F-288, F-128, F-80, F-40, F-20, F-10, F-4, F-2, F-1, A-5000, A-2500, A-1000 and A-500) are used.

(Melting Point Tm(C) [° C.] of Crystalline Polyester Resin, or the Like)

The glass transition temperature Tg of the toner, and the melting point Tm(C) [° C.], the amount of heat to be absorbed, and the degree of crystallization of the crystalline polyester resin are determined with a differential scanning calorimeter (trade name: Q1000, manufactured by TA Instruments) according to ASTM D3418-82.

Temperature correction in a detector of the apparatus is performed based on the melting points of indium and zinc. Correction of the amount of heat is performed based on heat of fusion of indium.

Specifically, the toner (5 mg) or the crystalline polyester resin (1 mg) is precisely weighed, and is placed in an aluminum pan. An empty aluminum pan is used as a reference. Modulated measurement is performed in the measurement range of 20° C. to 140° C. on the following settings:

temperature raising rate: 1° C./min
amplitude temperature width: ±0.318° C./min

In the temperature raising process, specific heat changes are obtained in the temperature range of 20° C. to 140° C. The glass transition temperature Tg of the toner is defined as a point of intersection of a line from a mid-point of a baseline before and after specific heat changes appear in a reversible specific heat curve and a DSC curve. The melting point Tm(C) [° C.] of the crystalline polyester resin is defined as the largest endothermic peak temperature in the specific heat curve.

(Acid Value Av(C) of Crystalline Polyester Resin)

The acid value of the crystalline polyester resin is determined according to JIS K1557-1970. A specific measurement method will be described below.

A crushed product of a sample (2 g) is precisely weighed (W(g)). The sample is placed in a 200 mL conical flask, and a mixed solution 100 mL of toluene/ethanol (2:1) is added to dissolve the sample over 5 hours. A phenolphthalein solution is added as an indicator. The solution is titrated with an alcohol solution of 0.1 mol/L KOH (KOH solution) with a burette. The amount of the KOH solution at this time is S (mL). A blank test is performed, where the amount of the KOH solution is B (mL).

The acid value is calculated from the following expression:

$$\text{acid value}=\{(S-B)\times f\times 5.61\}/W$$

where f represents a factor of the KOH solution.

(Glass Transition Temperature Tg(H) [° C.] of Polar Polyester)

The glass transition temperature Tg(H) [° C.] of the polar polyester is determined with a differential scanning calorimeter (trade name: Q1000, manufactured by TA Instruments) according to ASTM D3418-82.

Temperature correction in a detector of the apparatus is performed based on the melting points of indium and zinc. Correction of the amount of heat is performed based on heat of fusion of indium.

Specifically, polar polyester (about 10 mg) is precisely weighed, and is placed in an aluminum pan. An empty aluminum pan is used as a reference. The measurement is performed in the measurement range of 30° C. to 200° C. at a temperature raising rate of 10° C./min. In the temperature raising process, specific heat changes are obtained in the temperature range of 40° C. or more and 100° C. or less. The glass transition temperature Tg(H) of polar polyester is defined as a point of intersection of a mid-point of a baseline before and after specific heat changes appear and a DSC curve.

(Determination of SP Value)

SP values of the vinyl copolymer as the binder resin, the crystalline polyester resin, and the pigment dispersant are determined by turbidimetric titration as follows.

In a 50 mL sample tube, the vinyl copolymer, the crystalline polyester resin, or the pigment dispersant (about 1.48 g is precisely weighed) is dissolved in chloroform (about 10.00 g is precisely weighed). Next, one drop (about 200 mg) of methanol is added with a Pasteur pipette. The sample tube is closed, the mass is measured, and the solution is stirred for one minute with a micro rotor (total length of 3 mm×diameter of 3 mm) for a magnet stirrer. After stirring, whether the solution becomes cloudy or not is visually checked. When the solution is not cloudy, the procedure is repeated until the solution becomes cloudy.

The same operation as above is performed where methanol is replaced with heptane.

From the masses of chloroform and methanol or heptane when the solution becomes cloudy, the SP values of the vinyl copolymer, the crystalline polyester resin and the pigment dispersant are calculated from the following expressions:

$$\text{SP value of vinyl copolymer, crystalline polyester resin, or pigment dispersant}=(SP_\alpha+SP_\beta)/2$$

$$SP_\alpha=(Vm^{1/2}\times SPm+Vc\cdot mL^{1/2}\times SPc)/(Vm^{1/2}+Vc^{1/2})$$

$$SP_\beta=(Vc^{1/2}\times SPc+Vh^{1/2}\times SPh)/(Vc^{1/2}+Vh^{1/2})$$

Vm ($cm^3$): volume of methanol when the solution becomes cloudy (specific gravity of methanol: 0.792)

Vc ($cm^3$): volume of chloroform when the solution becomes cloudy (specific gravity of chloroform: 1.490)

Vh ($cm^3$): volume of heptane when the solution becomes cloudy (specific gravity of heptane: 0.684)

SPm: SP value of methanol (14.5 $cal/cm^3$)

SPc: SP value of chloroform (9.3 $cal/cm^3$)

SPh: SP value of heptane (7.4 $cal/cm^3$)

SPm, SPc and SPh are cited from the following literature:

Literature: Solubility Parameters: ALLAN F. M. BARTON Chemistry Department, Victoria University of Wellington, private Bag, Wellington, New Zealand, Received Jun. 7, 1974 (Revised Manuscript Received Oct. 29, 1974)

The SP value of the vinyl copolymer as the binder resin is defined as follows. Namely, only the vinyl polymerizable monomer and the initiator of the respective formulae in the toner particles in Examples and Comparative Examples described later are bulk polymerized on the same reaction conditions (temperature and time) as those for the toner particles to synthesize a resin. The SP value of the resin is defined as the SP value of the binder resin.

(Composition Analysis of Pigment Dispersant)

The structures of the polymer component and the pigment dispersant having an adsorbable component in the present invention are determined with the following apparatus.

$^1$H-NMR and $^{13}$C-NMR

ECA-400 (trade name) manufactured by JEOL, Ltd. (solvent used: deuterochloroform)

FT-NMR AVANCE-600 (trade name) manufactured by Bruker Corporation (solvent used: deuterochloroform)

Now, the present invention will be specifically described using Examples, but these will not limit the present invention.

(Production Example of Polymer Component (P-1) for Pigment Dispersant)

Propylene glycol monomethyl ether (100 parts by mass) was heated while an atmosphere was purged with nitrogen, and was refluxed at a solution temperature of 120° C. or more. A mixture of the following materials was dropped over 3 hours.

TABLE 1

| | |
|---|---|
| Styrene | 156 Parts by mass |
| Acrylic acid | 7.2 Parts by mass |
| Butyl acrylate | 9.6 Parts by mass |
| Stearyl acrylate | 48.7 Parts by mass |
| Styrene:acrylic acid:butyl acrylate:stearyl acrylate = 60:4:30:6 [mol ratio] | |
| tert-Butylperoxy benzoate [organic peroxide polymerization initiator, manufactured by NOF CORPORATION, trade name: PERBUTYL Z] | 1.25 Parts by mass |

After dropping, the solution was stirred for 3 hours. While the solution temperature was raised to 170° C., the solution was distilled under normal pressure. After the solution temperature reached 170° C., the solution was distilled under reduced pressure (1 hPa) for one hour to remove the solvent to prepare a resin solid product. The resin solid product was dissolved in tetrahydrofuran, and was reprecipitated with n-hexane to deposit a solid. The solid was filtered to prepare Polymer component (P-1). The number average molecular weight Mn of Polymer component (P-1) was 14,400.

(Production Examples of Polymer Components (P-2) to (P-21) for Pigment Dispersant)

In Polymer components (P-2) to (P-21), the polymerizable monomer and the composition ratio of the polymerizable monomer were changed as shown in Table 2, the amount of the initiator to be used was adjusted, and the molecular weight of the polymer component was adjusted such that the pigment dispersant had the molecular weight described later. Except these, Polymer components (P-2) to (P-21) were prepared in the same manner as in Polymer component (P-1).

TABLE 2

| | Composition ratio of monomers (mol ratio) | | | | | | | |
|---|---|---|---|---|---|---|---|---|
| | Styrene | Acrylic acid | Methyl acrylate | Butyl acrylate | Dodecyl acrylate | Stearyl acrylate | Behenyl acrylate | 2-(Dimethylamino)ethyl acrylate |
| P-1 | 60 | 4 | | 30 | | 6 | | |
| P-2 | 84 | 4 | | | | 12 | | |
| P-4 | 78.5 | 1.5 | | | | 20 | | |
| P-5 | 66 | 4 | 30 | | | | | |
| P-6 | 57 | 4 | | 29 | | | 10 | |
| P-7 | 82 | 4 | | | | 14 | | |
| P-8 | 92 | 4 | | | 4 | | | |
| P-9 | 77 | 4 | | 15 | | | 4 | |
| P-10 | 77 | 4 | 15 | | | | 4 | |
| P-11 | 84 | 4 | 8 | | | | | |
| P-12 | 56 | 8 | | 30 | | 6 | | |
| P-13 | 50.4 | 9.6 | | 30 | | 6 | | |
| P-14 | 60 | 4 | | 30 | | 6 | | |
| P-15 | 60 | 4 | | 30 | | 6 | | |
| P-16 | 60 | 4 | | 28.8 | | 6 | | 1.2 |
| P-17 | 60 | 4 | | 28.1 | | 6 | | 1.9 |
| P-18 | 60 | 4 | | 26 | | 6 | | 4 |
| P-19 | 62.6 | 1.4 | | | | | | |
| P-20 | 55.4 | 8.6 | | | | | | |
| P-21 | 52.8 | 11.4 | | | | | | |

(Production Example of Pigment Dispersant A1)

Compound (B-1) as the azo skeleton partial structure represented by Formula (3) was prepared by the following scheme:

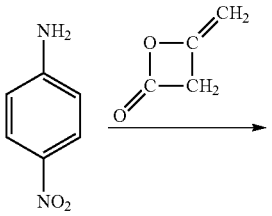

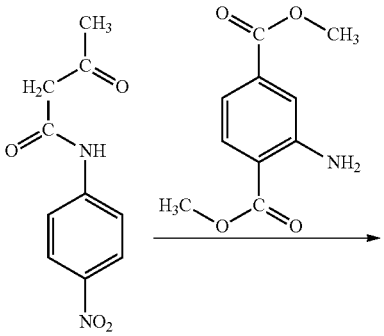

(27)

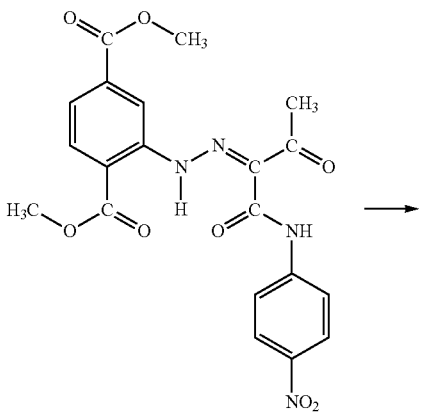

(28)

-continued

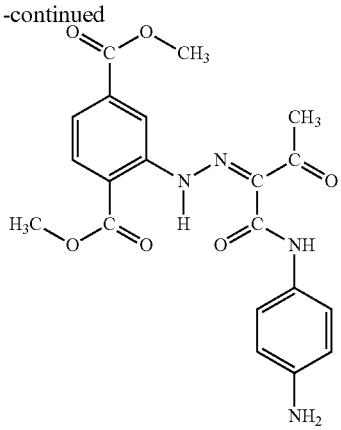

(B-1)

First, 4-nitroaniline (manufactured by Tokyo Chemical Industry Co., Ltd.) (3.11 parts by mass) was added to chloroform (30 parts by mass). The mixture was cooled with ice to 10° C. or less, and diketene (manufactured by Tokyo Chemical Industry Co., Ltd.) (1.89 parts by mass) was added. Subsequently, the mixture was stirred at 65° C. for 2 hours. After the reaction was terminated, the reaction product was extracted with chloroform, and was condensed to prepare Compound (27).

Next, methanol (40.00 parts by mass) and concentrated hydrochloric acid (5.29 parts by mass) were added to 2-aminodimethyl terephthalate (manufactured by Merck KGaA) (4.25 parts by mass), and the solution was cooled with ice to 10° C. or less. A dissolution solution of sodium nitrite (2.10 parts by mass) in water (6.00 parts by mass) was added to the cooled solution to make a reaction at the same temperature for one hour.

Sulfamic acid (0.990 parts by mass) was added, and the solution was further stirred for 20 minutes (diazonium salt solution). Compound (27) (4.51 parts by mass) was added to methanol (70.00 parts by mass). The solution was cooled with ice to 10° C. or less, and the diazonium salt solution was added.

Subsequently, a dissolution solution of sodium acetate (5.83 parts by mass) in water (7.00 parts by mass) was added, and the solution was reacted at 10° C. or less for 2 hours. After the reaction was terminated, water (300.00 parts by mass) was added, and the solution was stirred for 30 minutes. A solid was filtered, and was refined by recrystallization from N,N-dimethylformamide to prepare Compound (28).

Next, Compound (28) (8.58 parts by mass) and palladium-activated carbon (palladium: 5%) (0.40 parts by mass) were added to N,N-dimethylformamide (150.00 parts by mass), and the solution was stirred under an hydrogen gas atmosphere (reaction pressure: 0.1 to 0.4 MPa) at 40° C. for 3 hours. After the reaction was terminated, the solution was filtered, and was condensed to prepare Compound (B-1).

Next, an amino group of Compound (B-1) as the azo skeleton partial structure and a carboxy group of Polymer component (P-1) were bonded by amidization to prepare Pigment dispersant A1 by the following scheme:

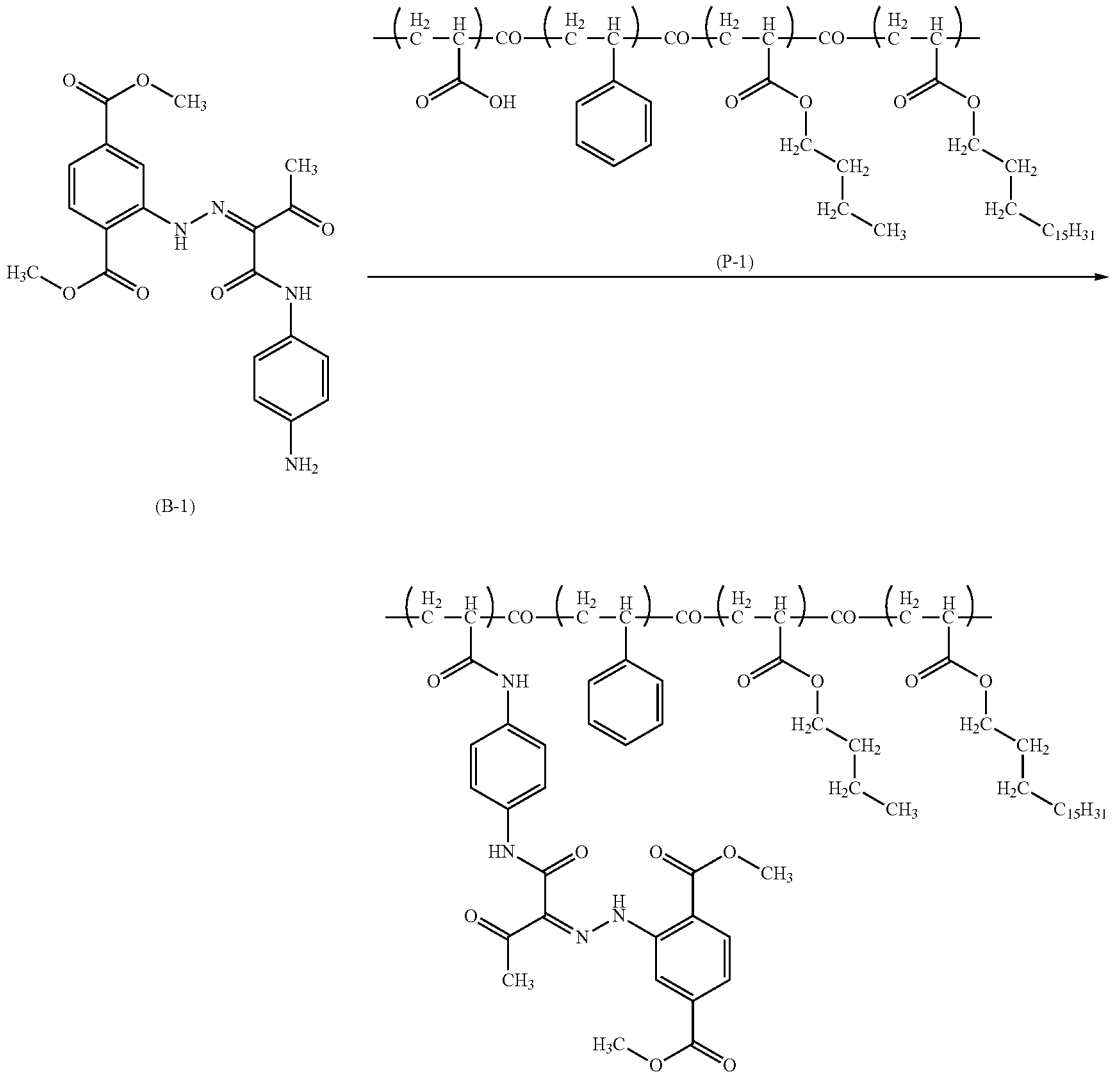

where "co" is a symbol indicating that units that form a copolymer are arranged at random.

First, Compound (B-1) (1.98 parts by mass) was added to tetrahydrofuran (500.00 parts by mass), and was heated to 80° C. to be dissolved. After Compound (B-1) was dissolved, the temperature was lowered to 50° C., Polymer component (P-1) (37.50 parts by mass) was added and dissolved. 1-ethyl-3-(3-dimethylaminopropyl)carbodiimide.hydrochloride (ED-C.HCl) (1.96 parts by mass) was added, and the solution was stirred at 50° C. for 5 hours.

Subsequently, the solution temperature was gradually returned to room temperature, and the solution was stirred overnight to terminate the reaction. After the reaction was terminated, the solution was filtered, condensed, and reprecipitated with methanol to be refined. Pigment dispersant A1 was prepared. The physical properties of the pigment dispersant are shown in Table 5.

(Production Example of Pigment Dispersant A2)

Pigment dispersant A2 was prepared in the same manner as in Pigment dispersant A1 except that Compound (B-1) in production of Pigment dispersant A1 was replaced with Compound (B-2). The values of physical properties of Pigment dispersant A2 are shown in Table 5.

(B-2)

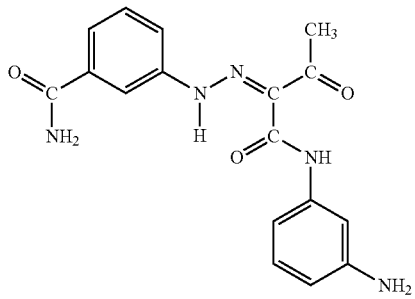

(Production Example of Pigment Dispersant A3)

Pigment dispersant A3 was prepared by the following scheme.

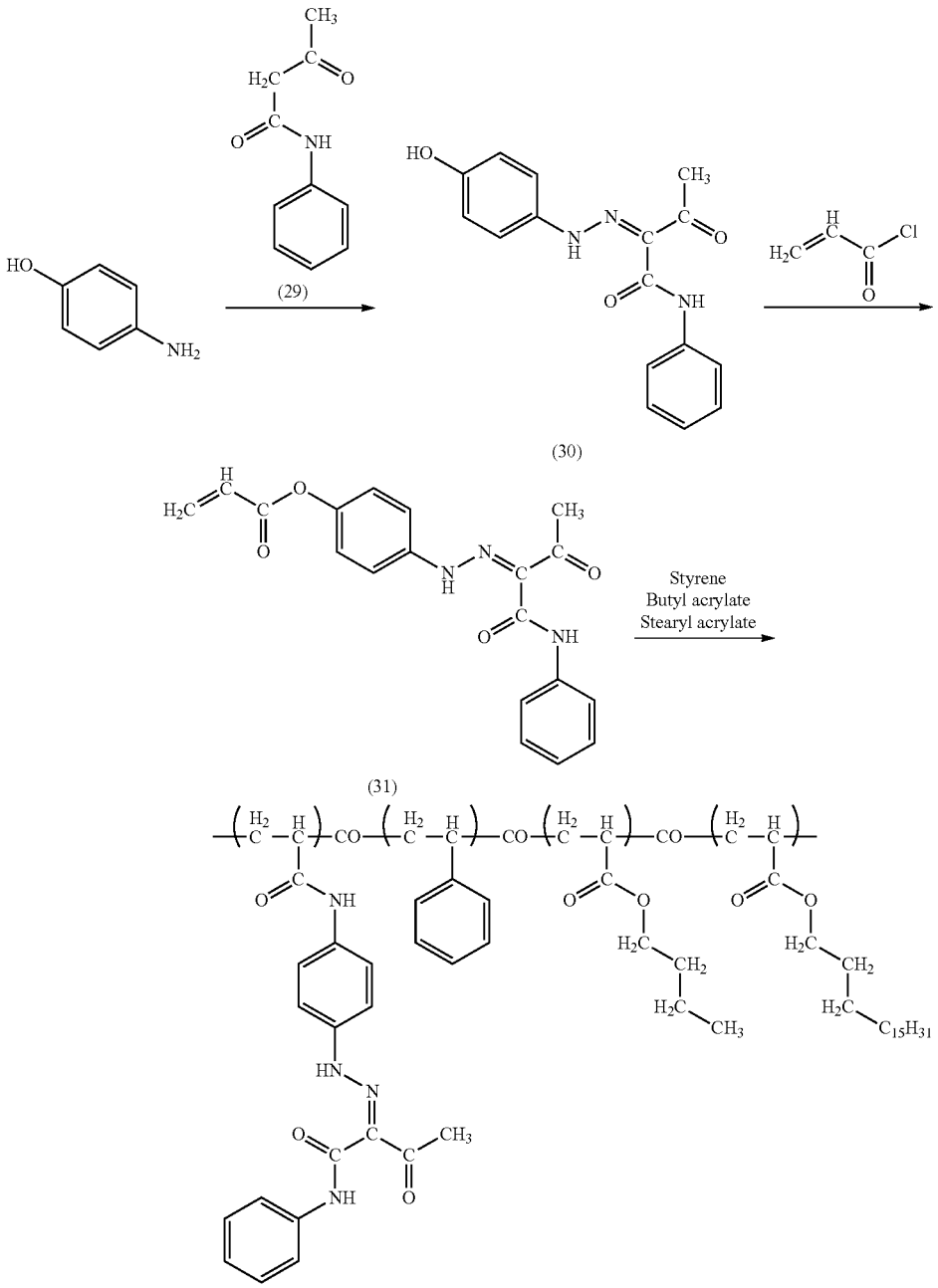

(Pigment dispersant A3)

where "co" is a symbol indicating that units that form a copolymer are arranged at random.

First, water (30.0 parts by mass) and concentrated hydrochloric acid (11.0 parts by mass) were added to 4-aminophenol (manufactured by Tokyo Chemical Industry Co., Ltd.) (5.00 parts by mass), and the solution was cooled with ice to 10° C. or less. A dissolution solution of sodium nitrite (3.46 parts by mass) in water (8.10 parts by mass) was added to the cooled solution, and was reacted at the same temperature for one hour. Sulfamic acid (0.657 parts by mass) was added, and was stirred for another 20 minutes (diazonium salt solution). Acetoacetanilide (manufactured by Tokyo Chemical Industry Co., Ltd.) (8.13 parts by mass) was added to water (48.0 parts by mass), and the solution was cooled with ice to 10° C. or less. The diazonium salt solution was then added. Subsequently, a dissolution solution of sodium carbonate (14.30 parts by mass) in water (80.00 parts by mass) was added, and was reacted at 10° C. or less for two hours. After the reaction was terminated, water (50.00 parts by mass) was added, and the solution was stirred for 30 minutes. A solid was filtered, and was refined by recrystallization from N,N-dimethylformamide to prepare Compound (30).

Next, Compound (30) (3.00 parts by mass) and triethylamine (1.20 parts by mass) were added to chloroform (30.00 parts by mass), and the solution was cooled with ice to 10° C. or less. Acryloyl chloride (manufactured by Tokyo Chemical Industry Co., Ltd.) (1.03 parts by mass) was added to the cooled solution, and was reacted at the same temperature for 20 minutes. The reaction product was extracted with chloroform, condensed, and refined to prepare Compound (31).

Next, Material B was added to Material A, and these were stirred under a nitrogen atmosphere at 80° C. for two hours.

TABLE 3

| | | |
|---|---|---|
| Material A | Styrene | 4.7 Parts by mass |
| | Butyl acrylate | 2.89 Parts by mass |
| | Stearyl acrylate | 1.47 Parts by mass |
| Material B | N,N-Dimethylformamide | 9.44 Parts by mass |
| | Compound (31) | 1.06 Parts by mass |
| | Azobisisobutyronitrile | 0.327 Parts by mass |

After the reaction was terminated, the product was refined by recrystallization from N,N-dimethylformamide to prepare Pigment dispersant A3. The physical properties of the pigment dispersant are shown in Table 5.

(Production Example of Pigment Dispersant A4)

Pigment dispersant A4 was prepared in the same manner as in Pigment dispersant A3 except that the substituents of Pigment dispersant A3 were changed to those shown in (B-4) in Table 4. The values of physical properties of Pigment dispersant A4 are shown in Table 5.

(Production Example of Pigment Dispersant A5)

Pigment dispersant A5 was prepared in the same manner as in Pigment dispersant A1 except that the substituents of Pigment dispersant A1 were changed to those shown in (B-5) in Table 4. The values of physical properties of Pigment dispersant A5 are shown in Table 5.

(Production Examples of Pigment Dispersants A6, A8 to A12, B3 and B5)

Pigment dispersants A6, A8 to A12, B3 and B5 were prepared in the same manner as in Pigment dispersant A1 except that the polymer component of Pigment dispersant A1 was changed as shown in Table 5. The values of physical properties of Pigment dispersants A6, A8 to A12, B3 and B5 are shown in Table 5.

(Production Examples of Pigment Dispersants A13, A14, B6 and B7)

Pigment dispersants A13, A14, B6 and B7 were prepared in the same manner as in Pigment dispersant A1 except that the polymer component in Production Example of Pigment dispersant A1 was changed as shown in Table 5. The values of physical properties of Pigment dispersants A13, A14, B6 and B7 are shown in Table 5.

(Production Examples of Pigment Dispersants A15 and A16)

Pigment dispersants A15 and A16 were prepared in the same manner as in Pigment dispersant A1 except that the substituents of Pigment dispersant A1 were changed as shown in (B-6) and (B-7) in Table 4, respectively. The values of physical properties of Pigment dispersants A15 and A16 are shown in Table 5.

(Production Example of Pigment Dispersant B8)

Pigment dispersant B8 was prepared in the same manner as in Pigment dispersant A1 except that Compound (B-1) in production of Pigment dispersant A1 was replaced with Compound (B-8). The values of physical properties of Pigment dispersant B8 are shown in Table 5.

(B-8)

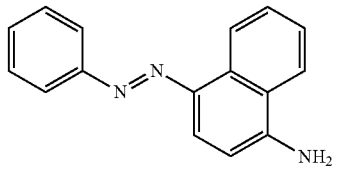

(Production Examples of Pigment Dispersants A17, A18 and A19)

Pigment dispersants A17, A18 and A19 were prepared in the same manner as in Pigment dispersant A6 except that the amount of Compound (B-1) to be added in Pigment dispersant A6 was reduced such that the acid values of the pigment dispersants were as shown in Table 5, respectively. The values of physical properties of Pigment dispersants A17, A18 and A19 are shown in Table 5.

(Production Examples of Pigment Dispersants A20, A21 and A22)

Pigment dispersants A20, A21 and A22 were prepared in the same manner as in Pigment dispersant A2 except that butyl acrylate in Polymer component (P-1) was partially replaced with 2-(dimethylamino)ethyl acrylate such that the amine values of the pigment dispersants were as shown in Table 5, respectively. The values of physical properties of Pigment dispersants A20, A21 and A22 are shown in Table 5.

(Production Examples of Pigment Dispersants A23, A24 and A25)

The composition ratio of the acrylic acid of Polymer component (P-1) was adjusted. According to the composition ratio of the acrylic acid, the amount of (B−1) to be added in Pigment dispersant A2 was also adjusted such that the number of pigment dispersants per molecule was as shown in Table 5. Pigment dispersants A23, A24 and A25 were prepared in the same manner as in Pigment dispersant A2 except these. The values of physical properties of Pigment dispersants A23, A24 and A25 are shown in Table 5.

TABLE 4

| | $R^4$ | $R^5$ | $R^{21}$ | $R^{22}$ | $R^{23}$ | $R^{24}$ | $R^{25}$ |
|---|---|---|---|---|---|---|---|
| B-1 | $CH_3$ | $R^2$-1 | H | $COOCH_3$ | H | H | $COOCH_3$ |
| B-2 | $CH_3$ | $R^2$-2 | H | H | H | $CONH_2$ | H |
| B-3 | $CH_3$ | NHPh | H | H | Ar-1 | H | H |
| B-4 | $CH_3$ | $NHCH_3$ | $CH_3$ | $CH_3$ | Ar-1 | H | H |
| B-5 | $CH_3$ | $R^2$-2 | H | H | H | $CH_3$ | H |
| B-6 | $CH_3$ | $R^2$-2 | H | $COOCH_3$ | H | H | $CH_3$ |
| B-7 | $CH_3$ | $CH_3$ | $CH_3$ | $CH_3$ | Ar-1 | H | H |

"Ar-1", "$R^2$-1" and "$R^2$-2" each represent a structure when bonded to the polymer component, i.e., a structure represented by Formula (Ar-1), a structure represented by Formula ($R^2$-1), and a structure represented by Formula ($R^2$-2). "ph" represents a "phenyl group."

(Ar-1)

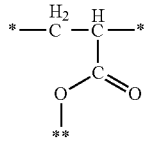

-continued (R²-1)

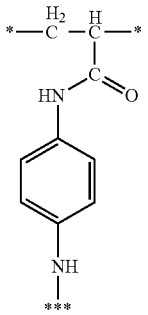

(R²-2)

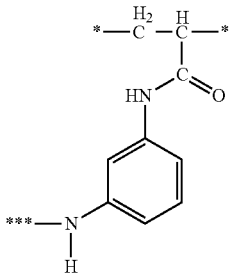

where a symbol "*" indicates that the structure is incorporated into the polymer component through chemical bond. Symbols "" and "*" indicate that the structure is bonded to "" and "*" in Formula, respectively.

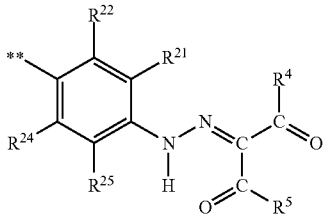

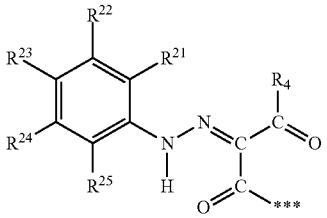

where $R^4$, $R^5$ and $R^{21}$ to $R^{25}$ are the same as $R^4$, $R^5$ and $R^{21}$ to $R^{25}$ in Formula (7).

TABLE 5

| | Polymer component | SP value of Pigment dispersant | Number average molecular weight Mn | Average number of adsorbable components | Acid value | Amine value |
|---|---|---|---|---|---|---|
| Pigment dispersant A1 | P-1 | 9.46 | 15400 | 2.8 | 3.2 | 0.0 |
| Pigment dispersant A2 | — | 9.45 | 15400 | 2.8 | 0.0 | 0.0 |
| Pigment dispersant A3 | P-1 | 9.32 | 15400 | 2.8 | 0.2 | 0.0 |
| Pigment dispersant A4 | P-1 | 9.30 | 15400 | 2.7 | 0.1 | 0.0 |
| Pigment dispersant A5 | P-1 | 9.30 | 15400 | 2.7 | 0.2 | 0.0 |
| Pigment dispersant A6 | P-2 | 8.10 | 15100 | 2.8 | 0.1 | 0.0 |
| Pigment dispersant B3 | P-4 | 8.00 | 15300 | 2.9 | 0.3 | 0.0 |
| Pigment dispersant A8 | P-6 | 8.60 | 15300 | 2.7 | 0.1 | 0.0 |
| Pigment dispersant A9 | P-7 | 8.30 | 15400 | 2.9 | 0.2 | 0.0 |
| Pigment dispersant A10 | P-8 | 9.90 | 15000 | 2.9 | 0.1 | 0.0 |
| Pigment dispersant A11 | P-9 | 10.10 | 14900 | 2.8 | 0.2 | 0.0 |
| Pigment dispersant A12 | P-10 | 10.40 | 14800 | 2.8 | 0.1 | 0.0 |
| Pigment dispersant B5 | P-11 | 10.60 | 15000 | 2.9 | 0.1 | 0.0 |
| Pigment dispersant A13 | P-12 | 8.90 | 2900 | 1.2 | 0.1 | 0.0 |
| Pigment dispersant B6 | P-13 | 8.89 | 2100 | 1.2 | 0.2 | 0.0 |
| Pigment dispersant A14 | P-14 | 9.48 | 19000 | 3.8 | 0.2 | 0.0 |
| Pigment dispersant B7 | P-15 | 9.49 | 24000 | 4.7 | 0.4 | 0.0 |
| Pigment dispersant A15 | P-1 | 9.36 | 15400 | 2.7 | 0.1 | 0.0 |
| Pigment dispersant A16 | P-1 | 9.21 | 15400 | 2.8 | 0.1 | 0.0 |
| Pigment dispersant B8 | P-1 | 9.12 | 15400 | 2.8 | 0.2 | 0.0 |
| Pigment dispersant A17 | P-1 | 8.61 | 15400 | 2.6 | 4.9 | 0.0 |
| Pigment dispersant A18 | P-1 | 9.49 | 15400 | 2 | 9.8 | 0.0 |
| Pigment dispersant A19 | P-1 | 9.95 | 15400 | 1.7 | 12.1 | 0.0 |
| Pigment dispersant A20 | P-16 | 9.47 | 14900 | 2.7 | 0.1 | 3.1 |
| Pigment dispersant A21 | P-17 | 9.49 | 14800 | 2.8 | 0.2 | 5.0 |
| Pigment dispersant A22 | P-18 | 9.53 | 14800 | 2.7 | 0.1 | 10.4 |
| Pigment dispersant A23 | P-19 | 9.00 | 14300 | 1.0 | 0.1 | 0.0 |
| Pigment dispersant A24 | P-20 | 9.63 | 15200 | 6.0 | 0.2 | 0.0 |
| Pigment dispersant A25 | P-21 | 9.88 | 15400 | 8.0 | 0.1 | 0.0 |

(Production Example of Crystalline Polyester Resin 1)

Sebacic acid (175.0 parts by mass), 1,9-nonanediol (166.5 parts by mass) and tetrabutyl titanate (0.3 parts by mass) were placed in a reaction apparatus provided with a stirrer, a thermometer and an air-flow type cooler, and were reacted at 180° C. for 6 hours. Subsequently, the pressure in the system was gradually reduced while the temperature was raised to 200° C. These components were reacted under reduced pressure for 5 hours to prepare Crystalline polyester resin 1. The physical properties of Crystalline polyester resin 1 are shown in Table 6.

(Production Example of Crystalline Polyester Resin 2)

Sebacic acid (175.0 parts by mass), 1,12-dodecanediol (210.1 parts by mass) and tetrabutyl titanate (0.2 parts) were placed in a reaction apparatus provided with a stirrer, a thermometer and an air-flow type cooler, and were reacted at 180° C. for 6 hours. Subsequently, the pressure in the system was gradually reduced while the temperature was raised to 2000° C. These components were reacted under reduced pressure for 5 hours to prepare Crystalline polyester resin 2. The physical properties of Crystalline polyester resin 2 are shown in Table 6.

(Production Example of Crystalline Polyester Resin 3)

Under a nitrogen atmosphere, xylene (50 parts), sebacic acid (175.0 parts by mass) and 1,12-dodecanediol (210.1 parts) were placed in a pressure-resistant reactor provided with a dropping funnel, a Liebig condenser and a stirrer, and the temperature was raised to 210° C. At this time, the pressure was 0.32 MPa.

Styrene (29.7 parts), acrylic acid (3.09 parts), and di-tert-butyl peroxide (trade name: Perbutyl D, manufactured by NOF Corporation) (2.09 parts) as a polymerization initiator were dissolved in xylene (10 parts) to prepare a mixture. The mixture was placed in a dropping funnel, and was dropped into the pressure-resistant reactor over two hours under increased pressure (0.31 MPa). After dropping, the reaction was made at 210° C. for another 3 hours to complete solution polymerization.

Subsequently, tetrabutoxy titanate (0.80 parts) was added, and the reaction mixture was condensation polymerized under a nitrogen atmosphere under normal pressure at 210° C. for 3 hours. Subsequently, tetrabutoxy titanate (0.010 parts) was added, and the reaction was made at 210° C. for two hours. Subsequently, the pressure was returned to normal pressure, benzoic acid (37.0 parts) and trimellitic acid (4.00 parts) were added, and the reaction was made at 220° C. for 5 hours to prepare Crystalline polyester resin 3. The physical properties of Crystalline polyester resin 3 are shown in Table 6.

(Production Example of Crystalline Polyester Resin 4)

Sebacic acid (100.0 parts by mass) and 1,10-decanediol (93.5 parts by mass) were placed in a reaction container provided with a stirrer, a thermometer, a nitrogen introducing pipe, a dehydration pipe and a pressure reducing apparatus, and were heated to 130° C. while being stirred. After titanium (IV) isopropoxide (0.7 parts by mass) as an esterification catalyst was added, the temperature was raised to 160° C., and condensation polymerization was performed over 5 hours. Subsequently, the temperature was raised to 1800° C. While the pressure was being reduced, the reaction was made until the molecular weight reached a predetermined molecular weight.

Polyester (1) was prepared. Polyester (1) had a weight average molecular weight (Mw) of 19,000 and a melting point (Tm) of 83° C.

Polyester (1) (100.0 parts by mass) and dehydration chloroform (440.0 parts by mass) were placed in a reaction container provided with a stirrer, a thermometer and a nitrogen introducing pipe, and were completely dissolved. Subsequently, triethylamine (5.0 parts by mass) was added, and 2-bromoisobutyryl bromide (15.0 parts by mass) was gradually added while being cooled with ice. Subsequently, the solution was stirred at room temperature (25° C.) all day and all night.

The resin dissolution solution was gradually dropped into a container containing methanol (550.0 parts by mass) to reprecipitate the resin content. The resin content was filtered, refined, and dried to prepare Polyester (2).

Polyester (2) (100.0 parts by mass), styrene (300.0 parts by mass), copper(I) bromide (3.5 parts by mass) and pentamethyldiethylenetriamine (8.5 parts by mass) were placed in a reaction container provided with a stirrer, a thermometer and a nitrogen introducing pipe. Subsequently, these were polymerized at 110° C. while being stirred. When the molecular weight reached a predetermined molecular weight, the reaction was terminated. The reaction product was reprecipitated with methanol (250.0 parts by mass), filtered, and refined to remove non-reacted styrene and the catalyst.

Subsequently, the reaction product was dried with a vacuum dryer set at 50° C. to prepare Crystalline polyester resin 4 having a crystalline polyester site and a non-crystalline vinyl polymer site. The physical properties of Crystalline polyester resin 4 are shown in Table 6.

(Production Examples of Crystalline Polyester Resins 5 and 6)

1,10-Decanediol (93.5 parts by mass) in Production Example of Crystalline polyester resin 4 was replaced with 1,9-nonanediol (83 parts by mass). The amount of styrene to be added was changed to 400.0 parts by mass and 450 parts by mass, respectively. Crystalline polyester resins 5 and 6 were prepared in the same manner as in Crystalline polyester resin 4 except these. The physical properties of Crystalline polyester resins 5 and 6 are shown in Table 6.

TABLE 6

| Crystalline polyester resin No. | *1 | *2 | Weight average molecular weight Mw | Acid value (mgKOH/g) | *3 | SP value (cal/cm$^3$) |
|---|---|---|---|---|---|---|
| 1 | 100/0 | 78.4 | 20100 | 4.1 | — | 9.60 |
| 2 | 100/0 | 85 | 19400 | 2.1 | — | 9.45 |
| 3 | 85/15 | 80 | 22000 | 2.9 | 5600 | 9.61 |
| 4 | 55/45 | 76 | 33000 | 0.2 | 7500 | 9.08 |
| 5 | 40/60 | 63 | 32000 | 0.4 | 9500 | 9.58 |
| 6 | 45/65 | 62 | 31500 | 0.2 | 10200 | 9.73 |

*1: Total amount of monomer for crystalline polyester site (monomer for condensed resin component)/total amount of monomer for non-crystalline vinyl polymer site (vinyl resin component monomer) (mass ratio)

*2: Melting point Tm(C.) [° C.] of crystalline polyester resin

*3: Weight average molecular weight (Mw) of non-crystalline vinyl polymer site (Production Example of Black Toner KA1)

Materials shown in Table 7 were prepared based on 100 parts by mass of a styrene monomer.

TABLE 7

| | |
|---|---|
| Carbon black: Nipex35 (manufactured by Orion Engineered Carbons zeta potential: −14 mV) | 20.0 Parts by mass |
| Pigment dispersant A1 | 1 Parts by mass |
| Aluminum compound of di-tertiary-butylsalicylic acid [BONTRON E88 (manufactured by ORIENT CHEMICAL INDUSTRIES CO., LTD.)] | 3.0 Parts by mass |

These materials were placed in an Attritor (manufactured by Mitsui Mining Co., Ltd.), and were stirred with zirconia beads having a radius of 1.25 mm (140 parts by mass) at 200 rpm and 25° C. for 180 minutes to prepare Masterbatch dispersion liquid 1.

A 0.1 mol/L $Na_3PO_4$ aqueous solution (450 parts by mass) was added to ion exchange water (710 parts by mass), and the solution was heated to 60° C. A 1.0 mol/L $CaCl_2$ aqueous solution (67.7 parts by mass) was gradually added to prepare an aqueous medium containing a calcium phosphate compound.

TABLE 8

| | |
|---|---|
| Masterbatch dispersion liquid 1 | 40 Parts by mass |
| Styrene monomer | 31 Parts by mass |
| n-Butyl acrylate monomer | 27 Parts by mass |
| Crystalline polyester 1 | 10 Parts by mass |
| Hydrocarbon wax (Fischer-Tropsch wax, peak temperature at the largest endothermic peak = 78° C., Mw = 750) | 9 Parts by mass |
| Polyester resin (polycondensate of terephthalic acid:isophthalic acid:propylene oxide-modified bisphenol A (2 mol adduct):ethylene oxide-modified bisphenol A (2 mol adduct) = 40:20:30:10, acid value 11, Tg = 75° C., Mw = 11,000, Mn = 4,000) | 5 Parts by mass |

Mw: weight average molecular weight

Materials shown in Table 8 were heated to 65° C., and were uniformly dissolved with a TK homomixer (manufactured by Tokushu Kika Kogyo Co., Ltd.) at 6,000 rpm to be dispersed. A 70% toluene solution of 1,1,3,3-tetramethylbutylperoxy 2-ethylhexanoate as a polymerization initiator (8.2 parts by mass) was dissolved in the solution to prepare a polymerizable monomer composition.

The polymerizable monomer composition was added to the aqueous medium, and was stirred at 65° C. under a nitrogen atmosphere with a TK homomixer at 18,000 rpm for 10 minutes to form particles of the polymerizable monomer composition (granulation). Subsequently, while the polymerizable monomer composition was being stirred with a paddle stirring blade, the temperature was raised to 67° C. When the polymerization conversion rate of the polymerizable vinyl monomer (the styrene monomer and the n-butyl acrylate monomer) reached 90%, an aqueous solution of 0.1 mol/L sodium hydroxide was added to adjust the pH of an aqueous dispersion medium to 9. The temperature was raised to 80° C. at a temperature raising rate of 40° C./h, and the reaction was made for 4 hours. At this time, the weight average particle diameter of the toner was 5.8 m, and D50 volume/D50 number was 1.1.

After the polymerization reaction was terminated, the remaining monomer was distilled off under reduced pressure. At this time, the weight average particle diameter of the toner was 5.8 μm, and D50 volume/D50 number was 1.25.

Subsequently, the aqueous medium was cooled, and hydrochloric acid was added to adjust the pH to 1.4. The solution was stirred for 6 hours to dissolve a calcium phosphate compound.

The toner particles were filtered, were washed by water, and were dried at 40° C. for 48 hours. The dried toner particles were classified with a multi-fraction classifier (Elbow-jet classifier manufactured by Nittetsu Mining Co., Ltd.) such that toner particles having a weight average particle diameter of 12.7 μm or more were 0.5% by mass and toner particles having the number average particle diameter of 4.0 μm or more were 20.0% by number. Black toner particle KA1 having a weight average particle diameter (D4) of 5.8 μm was thus prepared.

Materials shown in Table 9 were dry mixed with a Henschel mixer (manufactured by Mitsui Mining Co., Ltd.) for 5 minutes to prepare Black toner KA1.

TABLE 9

| | |
|---|---|
| Black toner particle KA1 | 100 Parts by mass |
| Silica fine particle (RY200: manufactured by Japan AEROSIL K.K.) | 1.5 Parts by mass |
| Rutil titanium oxide fine particle surface treated with dimethylsilicone oil (average primary particle diameter: 30 nm) | 0.2 Parts by mass |

(Production Examples of Black toners KA2 to KA25) Pigment dispersant A1 in Production Example of Black toner K1 was replaced with Pigment dispersants A2 to A26. The amount of the calcium phosphate compound was adjusted such that the toner particles after termination of the polymerization reaction had a weight average particle diameter of 5.8 μm. Black toners KA2 to KA25 were prepared in the same manner as in Black toner K1 except these.

(Production Examples of Black Toners KA26 to KA30)

Crystalline polyester resin 1 in Production Example of Black toner K1 was replaced with Crystalline polyester resins 2 to 6, and the amounts thereof to be added were changed to 11.8 parts by mass, 18.2 parts by mass, 25.0 parts by mass and 28.5 parts by mass. The amount of the styrene monomer (31 parts by mass) was changed to 29.2 parts by mass, 27.8 parts by mass, 16.0 parts by mass and 12.5 mass. The amount of the calcium phosphate compound was adjusted such that the toner particles after termination of the polymerization reaction had a weight average particle diameter of 5.8 μm. Black toners KA26 to KA30 were prepared in the same manner as in Black toner K1 except these.

(Production Example of Yellow Toner Y1)

Carbon black (20.0 parts by mass) in preparation of Black toner particle KA1 was replaced with Pigment yellow (C.I.

Pigment Yellow) 155 (trade name: Toner Yellow 3GP, manufactured by Clariant AG International Ltd.) (12.5 parts by mass). The amount of the calcium phosphate compound was adjusted such that the toner particles after termination of the polymerization reaction had a weight average particle diameter of 5.8 μm. Except these, Yellow toner particle Y1 having a weight average particle diameter (D4) of 5.8 μm was prepared in the same manner as in Black toner particle KA1.

Materials shown in Table 10 were dry mixed with a Henschel mixer (manufactured by Mitsui Mining Co., Ltd.) for 5 minutes to prepare Yellow toner Y1.

TABLE 10

| | |
|---|---|
| Yellow toner particle Y1 | 100 Parts by mass |
| Silica fine particle (RY200: manufactured by Japan AEROSIL K.K.) | 1.5 Parts by mass |
| Rutil titanium oxide fine particle surface treated with dimethylsilicone oil (average primary particle diameter: 30 nm) | 0.2 Parts by mass |

(Production Example of Magenta Toner M1)

Carbon black (20.0 parts by mass) in preparation of Black toner particle KA1 was replaced with Pigment Red (C.I. Pigment Red) 122 (16.5 parts by mass). The amount of the calcium phosphate compound was adjusted such that the toner particles after termination of the polymerization reaction had a weight average particle diameter of 5.8 μm. Except these, Magenta toner particle M1 having a weight average particle diameter (D4) of 5.8 μm was prepared in the same manner as in Black toner particle KA1.

Materials shown in Table 11 were dry mixed with a Henschel mixer (manufactured by Mitsui Mining Co., Ltd.) for 5 minutes to prepare Magenta toner M1.

TABLE 11

| | |
|---|---|
| Magenta toner particle M1 | 100 Parts by mass |
| Silica fine particle (RY200: manufactured by Japan AEROSIL K.K.) | 1.5 Parts by mass |
| Rutil titanium oxide fine particle surface treated with dimethylsilicone oil (average primary particle diameter: 30 nm) | 0.2 Parts by mass |

(Production Example of Magenta Toner M2)

Carbon black (20.0 parts by mass) in preparation of Black toner particle KA1 was replaced with Pigment Red (C.I. Pigment Red) 150 (16.5 parts by mass). The amount of the calcium phosphate compound was adjusted such that the toner particles after termination of the polymerization reaction had a weight average particle diameter of 5.8 μm. Except these, Magenta toner particle M2 having a weight average particle diameter (D4) of 5.8 μm was prepared in the same manner as in Black toner particle KA1.

Materials shown in Table 12 were dry mixed with a Henschel mixer (manufactured by Mitsui Mining Co., Ltd.) for 5 minutes to prepare Magenta toner M2.

TABLE 12

| | |
|---|---|
| Magenta toner particle M2 | 100 Parts by mass |
| Silica fine particle (RY200: manufactured by Japan AEROSIL K.K.) | 1.5 Parts by mass |
| Rutil titanium oxide fine particle surface treated with dimethylsilicone oil (average primary particle diameter: 30 nm) | 0.2 Parts by mass |

(Production Example of Black toner KB1) Black toner KB1 was prepared in the same manner as in Production Example of Black toner KA1 except that Pigment dispersant A1 was not added, and the amount of the calcium phosphate compound was adjusted such that the toner particles after termination of the polymerization reaction had a weight average particle diameter of 5.8 μm.

(Production Example of Black Toner KB2)

Black toner KB2 was prepared in the same manner as in Production Example of Black toner KA1 except that Crystalline polyester resin 1 was not added, and the amount of the calcium phosphate compound was adjusted such that the toner particles after termination of the polymerization reaction had a weight average particle diameter of 5.8 μm.

(Production Examples of Black Toners KB3 and KB5 to KB8)

Pigment dispersant A1 in Production Example of Black toner KA1 was replaced with Pigment dispersants B3 and B5 to B8, and the amount of calcium phosphate was adjusted such that the toner particles after termination of the polymerization reaction had a weight average particle diameter of 5.8 μm. Except these, Black toners KB3 and KB5 to KB8 were prepared in the same manner as in Production Example of Black toner KA1.

EXAMPLE 1

An image was evaluated using Black toner KA1 as a developer and A4 paper (manufactured by Canon Inc., 80 g/m$^2$) for a Color Laser Copier under an environment at 23° C. and a relative humidity of 50%. The image forming apparatus used was a modified machine of a commercially available laser beam printer LBP-5400 (trade name) (manufactured by Canon Inc.). The evaluation machine (modified machine) was modified as follows.

The gears of the evaluation machine main body and software were changed so as to change the process speed to 360 mm/sec.

A cyan cartridge was used in evaluation. Namely, the product toner was extracted from the commercially available cyan cartridge, and the inside of the cartridge was cleaned by air blow. Black toner KA1 (150 g) was placed in the cartridge to perform evaluation. The product toners were extracted from stations of magenta, yellow and black, respectively, and magenta, yellow and black cartridges where a mechanism for detecting an amount of a residual toner was canceled were mounted to perform evaluation. In Example 31 described later, a yellow cartridge was used instead of the cyan cartridge to perform evaluation. In Examples 32 and 33, a magenta cartridge was used instead of the cyan cartridge to perform evaluation.

(1) Amount of Toner to be Applied onto Paper at Image Density of 1.40

The laser beam printer was modified such that the temperature median during fixing was 160° C., and a 10 mm×10 mm solid image was output on the center of an A4 normal paper (trade name: GF-C081 A4, manufactured by Canon Marketing Japan Inc.) for measuring density. Developing contrast was adjusted such that the image density of the 10 mm×10 mm solid image for measuring density to be measured with a Macbeth reflection densitometer RD918 (manufactured by Macbeth) was 1.40.

The amount of an unfixed toner to be applied onto the paper ($mg/cm^2$) in the above setting was measured, and was ranked as follows.

TABLE 13

| Rank | |
|---|---|
| A | Less than 0.35 $mg/cm^2$. The pigment is dispersed much better by addition of the pigment dispersant, enabling a great reduction in the amount of the toner to be applied onto the paper. |
| B | 0.35 $mg/cm^2$ or more and less than 0.43 $mg/cm^2$. The pigment is dispersed well by addition of the pigment dispersant, enabling a reduction in the amount of the toner to be applied onto the paper. |
| C | 0.43 $mg/cm^2$ or more and less than 0.47 $mg/cm^2$. The pigment dispersion is the same as in the case where the pigment dispersant is not added, and there is no effect on the pigment dispersion. |
| D | 0.47 $mg/cm^2$ or more. The pigment is dispersed worse by addition of the pigment dispersant. |

(2) Low-temperature Fixability During High-speed Fixing

The evaluation machine (modified machine) was used to output an original image on a Business 4200 (manufactured by Xerox) having a base weight of 105 $g/m^2$ as a paper for evaluation at temperatures in the range from 130° C. to 220° C. while the setting temperature was changed by 5° C.

The original image is a solid patch image of a 10 mm square (amount of the toner to be applied is 0.90 $mg/cm^2$) located at the center of each division when the paper is divided into 9 divisions.

The fixed images output at the respective temperatures were subjected to a friction resistance test to determine the lowest fixable temperature.

The lowest fixable temperature is determined as follows: in the respective patches, the image density of the fixed image and the image density of the fixed image rubbed with lens-cleaning paper 5 times at a load of 50 $g/cm^2$ are measured, and the average value of the rate of decrease in density is determined. When the rate of decrease in density is 10% or less, the fixing temperature of the fixed image is defined as the lowest fixable temperature of the image.

The image density was determined with a Macbeth reflection densitometer (trade name: RD918, manufactured by Macbeth).

The image density was ranked as follows.

TABLE 14

| Rank | |
|---|---|
| A | A stably fixed image is obtained at a lowest fixing temperature of 160° C. or less. |
| B | A stably fixed image is obtained at a lowest fixing temperature of more than 160° C. and 175° C. or less. |
| C | A stably fixed image is obtained at a lowest fixing temperature of more than 175° C. and 190° C. or less. |
| D | The lowest fixing temperature is more than 190° C., or the image has no fixing temperature. |

(3) Fogging

The evaluation machine (modified machine) was used to perform a durability test (fixing setting temperature: 160° C.) to evaluate the durability of the toner.

In the durability test, the original image having a coverage rate of 2% was output on 3,000 sheets per day under a high temperature and high humidity environment (30° C., 80% RH), a normal temperature and normal humidity environment (23° C., 50% RH), and a low temperature and low humidity environment (15° C., 10% RH), respectively. A total of 12,000 sheets for 4 days was output under each of the environments. The timing of evaluation was every 1,000 sheets and the first sheet on each evaluation day. A solid white image was output at this timing, and was evaluated on the following evaluation criteria. The paper used was an A4 normal paper (trade name: GF-C081 A4, manufactured by Canon Marketing Japan Inc.).

The reflectance of a reference paper and that of a blank part of a printout image were measured with a REFLECTMETER MODEL TC-6DS (trade name) (manufactured by Tokyo Denshoku Co., Ltd.), and fogging (reflectance [%]) was calculated from an expression. A blue filter was mounted in the measurement.

The lowest value of the durability test was evaluated on the following evaluation criteria.

TABLE 15

| Rank | |
|---|---|
| A | Less than 1.0% |
| B | 1.0% or more and less than 2.0% |
| C | 2.0% or more and less than 3.0% |
| D | 3.0% or more |

fogging (reflectance, %)=(reflectance of reference paper, %)−(reflectance of sample, %)

(4) Stability of Image Density

The image density was measured with a color reflection densitometer (X-RITE 404A manufactured by X-Rite, Incorporated Co.). In the image output test under the high temperature and high humidity environment, one sheet of a solid image was output before and after the machine was left for 1 week, and the densities of the images were measured. Among the image densities determined, the difference between the largest density and the lowest density was determined to evaluate the difference on the following evaluation criteria.

TABLE 16

| Rank | |
|---|---|
| A | The difference in the image density is 0.3 or less. |
| B | The difference in the image density is more than 0.3 and 0.5 or less. |
| C | The difference in the image density is more than 0.5. |

(5) Storage Stability

To evaluate storage stability, the blocking resistance of the toner was evaluated. A toner (about 10 g) was placed in a 100 mL plastic cup, and the cup was left at 55° C. for 3 days. The toner was visually evaluated on the following evaluation criteria.

TABLE 17

| Rank | |
|---|---|
| A | No aggregated product is found. |
| B | An aggregated product is slightly found, but is easily broken. |
| C | An aggregated product is found, but is easily broken. |
| D | A large amount of aggregated products is found, but can be broken by shaking the cup. |
| E | A very large amount of aggregated products is found, and cannot be easily broken. |

Toner 1 was evaluated on the condition. Toner 1 exhibits satisfactory low-temperature fixability during high-speed output. Toner 1 also exhibits satisfactory hot offset resistance, charge uniformity, fogging and storage stability. The results are shown in Tables 18 and 19.

[EXAMPLES 2 to 33 and COMPARATIVE EXAMPLES 1 to 3 and 5 to 8]

Instead of Black toner KA1 in Example 1, the toners shown in Tables 18 and 19 were used and evaluated. The results of evaluation are shown in Tables 18 and 19.

TABLE 18

| | | | | | SP value | | |
|---|---|---|---|---|---|---|---|
| | Toner | Toner particle | Pigment dispersant | Crystalline polyester No. | Binder resin | Pigment dispersant | Crystalline polyester |
| Example 1 | KA1 | KA1 | A1 | 1 | 9.2 | 9.5 | 9.6 |
| Example 2 | KA2 | KA2 | A2 | 1 | 9.2 | 9.5 | 9.6 |
| Example 3 | KA3 | KA3 | A3 | 1 | 9.2 | 9.3 | 9.6 |
| Example 4 | KA4 | KA4 | A4 | 1 | 9.2 | 9.3 | 9.6 |
| Example 5 | KA5 | KA5 | A5 | 1 | 9.2 | 9.3 | 9.6 |
| Example 6 | KA6 | KA6 | A6 | 1 | 9.2 | 8.1 | 9.6 |
| Example 8 | KA8 | KA8 | A8 | 1 | 9.2 | 8.6 | 9.6 |
| Example 9 | KA9 | KA9 | A9 | 1 | 9.2 | 8.3 | 9.6 |
| Example 10 | KA10 | KA10 | A10 | 1 | 9.2 | 9.9 | 9.6 |
| Example 11 | KA11 | KA11 | A11 | 1 | 9.2 | 10.1 | 9.6 |
| Example 12 | KA12 | KA12 | A12 | 1 | 9.2 | 10.4 | 9.6 |
| Example 13 | KA13 | KA13 | A13 | 1 | 9.2 | 8.9 | 9.6 |
| Example 14 | KA14 | KA14 | A14 | 1 | 9.2 | 9.5 | 9.6 |
| Example 15 | KA15 | KA15 | A15 | 1 | 9.2 | 9.4 | 9.6 |
| Example 16 | KA16 | KA16 | A16 | 1 | 9.2 | 9.2 | 9.6 |
| Example 17 | KA17 | KA17 | A17 | 1 | 9.2 | 8.6 | 9.6 |
| Example 18 | KA18 | KA18 | A18 | 1 | 9.2 | 9.5 | 9.6 |
| Example 19 | KA19 | KA19 | A19 | 1 | 9.2 | 10.0 | 9.6 |
| Example 20 | KA20 | KA20 | A20 | 1 | 9.2 | 9.5 | 9.6 |
| Example 21 | KA21 | KA21 | A21 | 1 | 9.2 | 9.5 | 9.6 |
| Example 22 | KA22 | KA22 | A22 | 1 | 9.2 | 9.5 | 9.6 |
| Example 23 | KA23 | KA23 | A23 | 1 | 9.2 | 9.0 | 9.6 |
| Example 24 | KA24 | KA24 | A24 | 1 | 9.2 | 9.6 | 9.6 |
| Example 25 | KA25 | KA25 | A25 | 1 | 9.2 | 9.9 | 9.6 |
| Example 26 | KA26 | KA26 | A1 | 2 | 9.2 | 9.5 | 9.5 |
| Example 27 | KA27 | KA27 | A1 | 3 | 9.2 | 9.5 | 9.1 |
| Example 28 | KA28 | KA28 | A1 | 4 | 9.2 | 9.5 | 9.1 |
| Example 29 | KA29 | KA29 | A1 | 5 | 9.2 | 9.5 | 9.2 |
| Example 30 | KA30 | KA30 | A1 | 6 | 9.2 | 9.5 | 9.2 |
| Example 31 | Y1 | Y1 | A32 | 1 | 9.2 | 9.5 | 9.6 |
| Example 32 | M1 | M1 | A33 | 1 | 9.2 | 9.5 | 9.6 |
| Example 33 | M2 | M2 | A34 | 1 | 9.2 | 9.5 | 9.6 |
| Comparative Example 1 | KB1 | KB1 | — | 1 | 9.2 | — | 9.6 |
| Comparative Example 2 | KB2 | KB2 | A2 | — | 9.2 | 9.5 | — |
| Comparative Example 3 | KB3 | KB3 | B3 | 1 | 9.2 | 8.0 | 9.6 |
| Comparative Example 5 | KB5 | KB5 | B5 | 1 | 9.2 | 10.6 | 9.6 |
| Comparative Example 6 | KB6 | KB6 | B6 | 1 | 9.2 | 8.9 | 9.6 |
| Comparative Example 7 | KB7 | KB7 | B7 | 1 | 9.2 | 9.5 | 9.6 |
| Comparative Example 8 | KB8 | KB8 | B8 | 1 | 9.2 | 9.1 | 9.6 |

TABLE 19

| | Difference in SP value between pigment dispersant and binder resin (A-C) | Difference in SP value between pigment dispersant and crystalline polyester (A-B) | Rate of adsorption of pigment dispersant to pigment | Result of evaluation Amount of toner to be applied at image density of 1.40 | Low-temperature fixability | Image fogging | Image density stability | Storage stability |
|---|---|---|---|---|---|---|---|---|
| Example 1 | 0.3 | −0.1 | 95 | A (0.33) | A | A (0.2) | A (0.1) | A |
| Example 2 | 0.3 | −0.2 | 97 | A (0.33) | A | A (0.1) | A (0.1) | A |
| Example 3 | 0.1 | −0.3 | 48 | A (0.34) | A | A (0.3) | A (0.2) | A |
| Example 4 | 0.1 | −0.3 | 43 | A (0.34) | A | A (0.3) | A (0.3) | A |
| Example 5 | 0.1 | −0.3 | 89 | A (0.34) | A | A (0.4) | A (0.3) | A |
| Example 6 | −1.1 | −1.5 | 93 | B (0.42) | B | B (1.0) | B (0.4) | B |
| Example 8 | −0.6 | −1.0 | 94 | A (0.34) | A | A (0.7) | A (0.3) | A |
| Example 9 | −0.9 | −1.3 | 93 | B (0.42) | B | A (0.9) | B (0.4) | B |
| Example 10 | 0.7 | 0.3 | 92 | A (0.34) | A | A (0.7) | A (0.3) | A |
| Example 11 | 0.9 | 0.5 | 90 | B (0.37) | B | A (1.0) | B (0.4) | B |
| Example 12 | 1.2 | 0.8 | 92 | B (0.40) | B | B (1.1) | B (0.4) | B |
| Example 13 | −0.3 | −0.7 | 91 | B (0.42) | B | B (1.0) | B (0.4) | B |
| Example 14 | 0.3 | −0.1 | 90 | B (0.41) | B | B (1.2) | B (0.4) | B |
| Example 15 | 0.2 | −0.2 | 71 | A (0.35) | A | A (0.8) | A (0.3) | A |
| Example 16 | 0.0 | −0.4 | 31 | B (0.42) | B | B (1.0) | B (0.4) | B |
| Example 17 | −0.6 | −1.0 | 91 | A (0.35) | B | B (0.9) | A (0.2) | B |
| Example 18 | 0.3 | −0.1 | 88 | B (0.37) | B | B (1.3) | A (0.3) | B |
| Example 19 | 0.8 | 0.4 | 86 | B (0.39) | B | B (1.7) | B (0.5) | B |
| Example 20 | 0.3 | −0.1 | 95 | A (0.34) | B | B (1.0) | A (0.3) | B |
| Example 21 | 0.3 | −0.1 | 96 | A (0.35) | B | B (1.5) | B (0.4) | B |
| Example 22 | 0.4 | −0.1 | 97 | B (0.37) | B | B (1.9) | B (0.5) | B |
| Example 23 | −0.2 | −0.6 | 90 | A (0.35) | A | A (0.4) | A (0.3) | A |
| Example 24 | 0.5 | 0.0 | 95 | B (0.37) | A | A (0.4) | A (0.3) | A |
| Example 25 | 0.7 | 0.3 | 97 | B (0.41) | B | B (0.9) | B (0.4) | A |
| Example 26 | 0.3 | 0.0 | 97 | A (0.35) | A | A (0.3) | A (0.3) | A |
| Example 27 | 0.3 | 0.4 | 97 | A (0.33) | A | A (0.1) | A (0.1) | A |
| Example 28 | 0.3 | 0.4 | 97 | A (0.35) | A | A (0.3) | A (0.3) | A |
| Example 29 | 0.3 | 0.3 | 97 | B (0.38) | B | B (0.9) | B (0.4) | B |
| Example 30 | 0.3 | 0.3 | 97 | B (0.38) | B | B (1.3) | B (0.5) | C |
| Example 31 | 0.3 | −0.1 | 77 | A (0.33) | A | A (0.2) | A (0.1) | A |
| Example 32 | 0.3 | −0.1 | 93 | A (0.34) | A | A (0.3) | A (0.2) | A |
| Example 33 | 0.3 | −0.1 | 81 | A (0.34) | A | A (0.3) | A (0.3) | A |
| Comparative Example 1 | — | — | — | D (0.49) | A | A (1.0) | A (0.3) | B |
| Comparative Example 2 | 0.3 | — | 95 | A (0.33) | D | A (0.3) | A (0.1) | A |
| Comparative Example 3 | −1.2 | −1.6 | 90 | C (0.44) | B | C (2.9) | C (0.5) | C |
| Comparative Example 5 | 1.4 | 1.0 | 90 | C (0.44) | B | D (3.1) | C (0.6) | C |
| Comparative Example 6 | −0.3 | −0.7 | 90 | C (0.46) | B | C (2.8) | C (0.5) | C |
| Comparative Example 7 | 0.3 | -0.1 | 88 | C (0.44) | B | D (3.0) | C (0.6) | D |
| Comparative Example 8 | −0.1 | −0.5 | 23 | D (0.47) | B | C (2.6) | C (0.5) | C |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2013-175086, filed Aug. 26, 2013, and No. 2014-165541, filed Aug. 15, 2014 which are hereby incorporated by reference herein in their entirety.

What is claimed is:

1. A toner comprising toner particles prepared by forming particles of a polymerizable monomer composition comprising a polymerizable monomer, a pigment, a pigment dispersant and a crystalline polyester resin in an aqueous medium, and polymerizing the polymerizable monomer contained in the particles, wherein the polymerizable monomer is a polymerizable monomer for preparing a vinyl copolymer, the pigment dispersant satisfies (i) to (v):

(i) a difference (A−B) between an SP value (A) of the pigment dispersant and an SP value (B) of the crystalline polyester resin is −1.5 or more and +0.8 or less, (ii) a difference (A−C) between the SP value (A) of the pigment dispersant and an SP value (C) of the vinyl copolymer is −1.1 or more and +1.2 or less, (iii) the pigment dispersant contains a polymer component and an adsorbable component adsorbed to the pigment, and the polymer component is a vinyl polymer, (iv) the polymer component of the pigment dispersant has a number average molecular weight (Mn) of 3,000 or more and 20,000 or less, and (v) a rate of adsorption of the pigment dispersant to the pigment is 30% or more.

2. The toner according to claim 1, wherein the polymer component of the pigment dispersant has a unit represented by Formula (6):

(6)

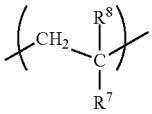

where $R^8$ represents a hydrogen atom or an alkyl group; $R^7$ represents a phenyl group, a carboxy group, a carboxylic acid ester group or a carboxylic acid amide group.

3. The toner according to claim 1, wherein the polymer component of the pigment dispersant has a unit represented by Formula (1):

(1)

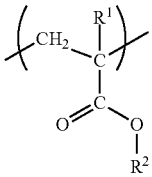

where $R^1$ represents a hydrogen atom or an alkyl group; $R^2$ represents a hydrogen atom, an alkyl group, a phenyl group, an aralkyl group or an amide group.

4. The toner according to claim 1, wherein the polymer component of the pigment dispersant has a unit represented by Formula (2):

(2)

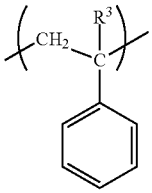

where $R^3$ represents a hydrogen atom or an alkyl group.

5. The toner according to claim 1, wherein the adsorbable component of the pigment dispersant has a partial structure represented by Formula (3):

(3)

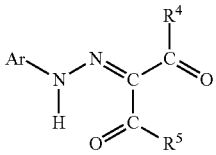

where one of $R^4$, $R^5$ and Ar is a structure that binds to the polymer component through a single bond or a linking group;

$R^4$ represents an alkyl group, a phenyl group, a monovalent group represented by —$OR^8$ (where $R^8$ represents a hydrogen atom, an alkyl group, a phenyl group or an aralkyl group), or a monovalent group represented by —$NR^9R^{10}$ (where $R^9$ and $R^{10}$ each independently represent a hydrogen atom, an alkyl group, a phenyl group or an aralkyl group), or a structure that binds to the polymer component through a single bond or a linking group (in this case, the structure corresponding to an alkyl group, a phenyl group, a monovalent group represented by —$OR^8$, or a monovalent group represented by —$NR^9R^{10}$ from which one hydrogen atom is removed); when $R^4$ is a structure that binds to the polymer component, the linking group binding to $R^4$ is an amide group, an ester group, a urethane group, a urea group, an alkylene group, a phenylene group, a divalent group represented by —O—, a divalent group represented by —$NR^6$— (where $R^6$ represents a hydrogen atom, an alkyl group, a phenyl group or an aralkyl group), or a divalent group represented by —$NHCH(CH_2OH)$—;

$R^5$ represents an alkyl group, a phenyl group, a monovalent group represented by —$OR^8$ (where $R^8$ represents a hydrogen atom, an alkyl group, a phenyl group or an aralkyl group), or a monovalent group represented by —$NR^9R^{10}$ (where $R^9$ and $R^{10}$ each independently represent a hydrogen atom, an alkyl group, a phenyl group or an aralkyl group), or a structure that binds to the polymer component through a single bond or a linking group (in this case, the structure corresponding to an alkyl group, a phenyl group, a monovalent group represented by —$OR^8$, or a monovalent group represented by —$NR^9R^{10}$ from which one hydrogen atom is removed); when $R^5$ is a structure that binds to the polymer component, the linking group binding to $R^5$ is an alkylene group, a phenylene group, a divalent group represented by —O—, a divalent group represented by —$NR^6$— (where $R^6$ represents a hydrogen atom, an alkyl group, a phenyl group or an aralkyl group), a divalent group represented by —$NHCOC(CH_3)_2$—, or a divalent group represented by —$NHCH(CH_2OH)$—;

Ar represents an aryl group or a structure that binds to the polymer component through a single bond or a linking group (in this case, the structure corresponding to an aryl group from which one hydrogen atom is removed); when Ar is a structure that binds to the polymer component, the linking group binding to Ar is an amide group, an ester group, a urethane group, a urea group, an alkylene group, a phenylene group, a divalent group represented by —O—, a divalent group represented by —$NR^6$— (where $R^6$ represents a hydrogen atom, an alkyl group, a phenyl group or an aralkyl group), or a divalent group represented by —$NHCH(CH_2OH)$—.

6. The toner according to claim 1, wherein the average number of the adsorbable components per molecule of the pigment dispersant is 1 or more and 6 or less.

7. The toner according to claim 1, wherein the crystalline polyester resin is a polyester resin prepared by reacting an aliphatic dicarboxylic acid represented by Formula (4):

$$HOOC—(CH_2)_m—COOH \quad (4)$$

where m represents an integer of 4 or more and 16 or less; and an aliphatic diol represented by Formula (5):

$$HO—(CH_2)_n—OH \quad (5)$$

where n represents an integer of 4 or more and 16 or less.

8. The toner according to claim 1, wherein the pigment dispersant has an acid value of 10 mgKOH/g or less.

9. The toner according to claim 1, wherein the pigment dispersant has an amine value of 5 mgKOH/g or less.

10. The toner according to claim 1, wherein the pigment has a π-conjugate plane.

11. The toner according to claim 1, wherein the pigment is at least one selected form the group consisting of carbon black, Pigment yellow 155, Pigment Red 122 and Pigment Red 150.

* * * * *